US010413031B1

(12) United States Patent
Gerber et al.

(10) Patent No.: US 10,413,031 B1
(45) Date of Patent: Sep. 17, 2019

(54) CONTAINER WITH MALLEABLE HANDLES HAVING UNMALLEABLE PORTIONS

(71) Applicant: Roxilla LLC, New York, NY (US)

(72) Inventors: Danielle Evin Gerber, New York, NY (US); Rock G. Positano, New York, NY (US)

(73) Assignee: ROXILLA LLC, New York, NY (US)

( * ) Notice: Subject to any disclaimer, the term of this patent is extended or adjusted under 35 U.S.C. 154(b) by 0 days.

(21) Appl. No.: 15/596,581

(22) Filed: May 16, 2017

Related U.S. Application Data

(60) Provisional application No. 62/336,788, filed on May 16, 2016.

(51) Int. Cl.

| | |
|---|---|
| ***A45C 11/20*** | (2006.01) |
| ***A45C 13/26*** | (2006.01) |
| ***A45C 1/02*** | (2006.01) |
| ***A45C 3/06*** | (2006.01) |

(52) U.S. Cl.
CPC ..... *A45C 13/26* (2013.01); *A45C 1/02* (2013.01); *A45C 3/06* (2013.01); *A45C 11/20* (2013.01)

(58) Field of Classification Search
CPC .. A45C 13/26; A45C 1/02; A45C 3/06; A45C 11/20
USPC ..... 206/549, 227, 349, 371; 150/107, 108, 150/110; 190/39, 118, 117; 383/4, 22
See application file for complete search history.

(56) References Cited

U.S. PATENT DOCUMENTS

| | | | | |
|---|---|---|---|---|
| 1,119,293 A | | 9/1871 | Alexandre | |
| 1,047,941 A | | 12/1912 | Hollingsworth | |
| 2,031,218 A | | 2/1936 | Klotz | |
| 2,745,524 A | | 5/1956 | Plotkin | |
| 2,765,833 A | * | 10/1956 | Kwon | A45C 3/00 150/107 |
| 3,016,939 A | | 1/1962 | Lowy | |
| 3,061,157 A | | 10/1962 | Moss | |
| 3,519,110 A | | 7/1970 | Siris | |
| 3,912,141 A | | 10/1975 | Appel | |
| 4,023,842 A | | 5/1977 | Harvey | |
| 4,153,092 A | | 5/1979 | Haslam | |
| 4,341,410 A | | 7/1982 | Summach | |
| 4,856,570 A | | 8/1989 | Rushing et al. | |
| 6,076,783 A | | 6/2000 | Card | |
| 6,097,448 A | | 8/2000 | Perkins | |

(Continued)

FOREIGN PATENT DOCUMENTS

| | | |
|---|---|---|
| GB | 2214490 A | 6/1989 |
| GB | 2262511 A | 6/1993 |

OTHER PUBLICATIONS

Archived blog: DIY Purse Handles, dated Apr. 12, 2012.

(Continued)

*Primary Examiner* — Rafael A Ortiz

(74) *Attorney, Agent, or Firm* — Heslin Rothenberg Farley & Mesiti P.C.

(57) ABSTRACT

A container, such as a bag, including an article storage assembly, at least one malleable handle having a first end permanently or removably attached to the article storage assembly and a second end permanently or removably attached to the article storage assembly. The handle is bendable into various substantially rigid configurations. Each handle can also include an unmalleable portion. The container can be configured to allow the handles to be in at least two positions.

19 Claims, 30 Drawing Sheets

(56) References Cited

U.S. PATENT DOCUMENTS

| | | | | |
|---|---|---|---|---|
| 6,138,881 | A | 10/2000 | Paul et al. | |
| 6,317,924 | B1 | 11/2001 | Gallagher | |
| 6,488,189 | B1 | 12/2002 | Smith | |
| 6,494,619 | B1 | 12/2002 | Sulpizio | |
| 6,666,363 | B2 | 12/2003 | Godshaw et al. | |
| 6,698,474 | B1 | 3/2004 | Trsek | |
| 7,013,671 | B1 * | 3/2006 | Bolda | A45C 11/20 206/541 |
| 7,377,299 | B2 | 5/2008 | Gerber et al. | |
| 2003/0150082 | A1 | 8/2003 | Chen | |
| 2004/0039316 | A1 | 2/2004 | Smith | |
| 2004/0068838 | A1 | 4/2004 | Tsai | |
| 2004/0089686 | A1 | 5/2004 | Pratt et al. | |
| 2004/0154131 | A1 | 8/2004 | Earley et al. | |
| 2005/0126873 | A1 | 6/2005 | Matsumoto | |
| 2006/0162830 | A1 * | 7/2006 | Gerber | A45C 13/26 150/108 |
| 2007/0108247 | A1 * | 5/2007 | Bardes | A45C 3/04 224/581 |
| 2011/0011504 | A1 * | 1/2011 | Steinbacher | A01K 27/006 150/106 |

OTHER PUBLICATIONS

Paco Rabanne (/Designer/ Paco-Rabanne/N-WB P U S C ), 14#01 Pliage Bucket Bag, Barneys.com (http://www.barneyswarehouse.com/product/pacorabanne142301pliagebucketbag504396744.html), accessed May 9, 2017.

Paco Rabanne (/Designer/ Paco-Rabanne/N-WB P U S C ), Paco Rabanne 14#01 Pliage Mini Bucket Bag, Barneys.com (http://www.barneys.com/product/pacorabanne142301pliageminibucketbag504708330.html), accessed May 9, 2017.

Valentino, Bepop Studded Loop Clutch, Saks.com, http://www.saksfifthavenue.com/main/ProductDetail.jsp?FOLDER%3C%3Efolder_id=2534374306622829&PRODUCT%3C%3Eprd_id=845524447109134&R=8%E2%80%A6, accessed May 9, 2017.

* cited by examiner

CONTAINER WITH MALLEABLE HANDLES HAVING UNMALLEABLE PORTIONS

CROSS REFERENCE TO RELATED APPLICATIONS

The present application claims priority and the benefit of to U.S. Provisional Application No. 62/336,788, filed on May 16, 2016, the contents of which are hereby incorporated by reference in their entirety.

FIELD OF THE INVENTION

The present invention generally relates to containers, such as bags or purses, with malleable handles.

BACKGROUND OF THE INVENTION

Conventional art bags (such as standard purses, totes, wristlet, shoulder, crossbody, sling, fanny pack clutches, knapsacks, backpacks, duffel bags, gym bags, tennis bags, and yoga bags) typically have either flexible handles or inflexible handles. Such handles have limitations in the ways in which the purse can be worn. For example, with conventional leather strap handles, a purse-wearer basically has two options: (1) place the straps over her arm or shoulder; or (2) simply carry the purse in hand. However, when a purse becomes heavy, it is inconvenient and can be painful to carry the purse in these ways.

Further, the conventional handles limit the way the purse can be set aside when the purse-wearer is at rest. For example, women typically store their purse on the floor or on an adjacent seat when they sit down at, for example, a restaurant or movie theater. Thus, the purse and/or its contents become vulnerable to theft and, since public floors are typically quite dirty, the bottom of the purse is often soiled with bacteria or other contaminants, which is especially unwanted in the case of expensive designer. Furthermore, it can be difficult to access a purse from a sitting position when the purse is placed on the floor or an adjacent seat. There is added value for knowing where one's bag is as it's attached to the user. This allows the user to focus on the task at hand.

What is needed is an improved container, such as a purse, using handles that overcome these and other problems associated with conventional handles.

BRIEF DESCRIPTION OF THE DRAWINGS

Exemplary embodiments of the present invention will be described with reference to the accompanying figures, wherein.

SUMMARY OF INVENTION

Figure 1:
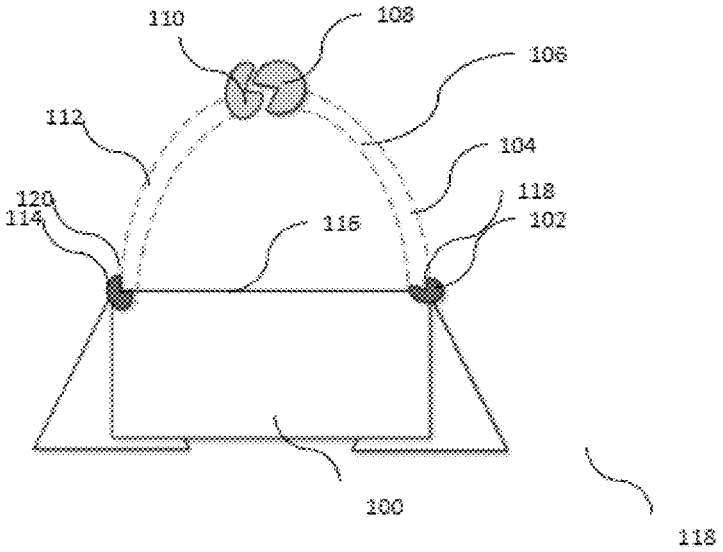
FIG. 1 shows a bag according to an exemplary embodiment of the invention.

The present invention generally relates to containers, such as bags, with one or more malleable handles.

An object of embodiments of the present invention is to provide a bag with a malleable handle that can maintain a plurality of shapes while supporting the bag. Such a malleable handle enables the bag to hang from various objects, including various locations on the human body, avoids theft because the bag could be protected by being kept on the body, and enhances comfort because the handles may conform to the body while wearing the bag traditionally. In embodiments, such handles can further include unmalleable portions.

According to exemplary embodiments, the bag comprises an article storage assembly, at least one handle comprising a first handle portion having a first end removably attached to the article storage assembly and a second end, and a second handle portion having a first end attached to the article storage assembly and a second end removably attached to the second end of the first handle portion. The first and second handle portions are shapeable into various substantially rigid configurations.

In exemplary embodiments, both handle portions are removably attached to the article storage assembly.

The present disclosure generally relates to bags with malleable handles.

In exemplary embodiments, at least one handle portion comprises a length adjusting apparatus that adjusts the length of the corresponding handle portion.

In exemplary embodiments, the bag comprises an article storage assembly, at least one handle comprising a first end removably attached to the article storage assembly, and a second end, the second end removably attached to the article storage assembly. The handle is shapeable into various substantially rigid configurations.

In exemplary embodiments, the second end of the handle is fixedly attached to the article storage assembly.

In exemplary embodiments, the bag comprises an article storage assembly, at least one rotating ball, and at least one handle fixedly attached to the ball. The ball is capable of rotating to allow the handle to point in a plurality of directions.

In exemplary embodiments, the bag comprises an article storage assembly, at least one handle that is shapeable into various substantially rigid configurations, and is in a shape conforming to the article storage assembly, secured fixedly or removably to at least two points on the bag.

In exemplary embodiments, the bag comprises an article storage assembly, at least one handle being shapeable into various substantially rigid configurations, secured to at least one point on the article storage assembly such that the handle can pivot around the securing point.

In exemplary embodiments, a bag strap comprises a substantially tubular piece with at least two ends, being shapeable into various substantially rigid configurations.

In exemplary embodiments, the substantially tubular piece is covered in at least one different material.

In exemplary embodiments, the first two ends of the substantially tubular piece are removably attachable to each other.

In exemplary embodiments, the bag comprises an article storage assembly, at least one handle being shapeable into various substantially rigid configurations, having two ends secured to at least one point on the article storage assembly such that the handle can move freely at all points not secured to the article storage assembly.

In exemplary embodiments, the bag comprises an article storage assembly, at least one handle that is shapeable into various substantially rigid configurations, in which the handle passes through the bag via ports in the bag.

In exemplary embodiments, the bag comprises an article storage assembly, at least one handle that is shapeable into various substantially rigid configurations, which is split into three handle portions. At least one handle portion is secured to the article storage assembly in a manner than enables it to move laterally.

In exemplary embodiments, the bag comprises an article storage assembly, at least two handles that are shapeable into various substantially rigid configurations, and each handle is secured to opposite ends of the article storage assembly.

In exemplary embodiments, the bag comprises an article storage assembly which is made of flexible material, at least two handles that are shapeable into various substantially rigid configurations, in which each handle is bent along a diameter.

In exemplary embodiments the handles are shapeable into various substantially rigid configurations and are substantially triangular.

In exemplary embodiments the invention is a container which includes an article storage assembly which includes a cavity for storage of one or more items and an opening. The opening has a first side of the opening with at least a portion of the first side including a first threading tube. The opening also has a second side of the opening in which at least a portion of the second side includes a second threading tube. The opening has a variable opening distance with a maximum opening distance between a center of the first side and a center of second side. The container also includes a first handle, which is bendable and retains its shape after bending. The first handle is threaded through the first threading tube with a first threaded length of the first handle enclosed by the threading tube. There is a first straight line length between a first point on the first handle which coincides with a first end of the first threading tube and a second point on the first handle which coincides with a second end of the first threading tube, and a first exposed length of the first handle not enclosed by the threading tube. The first handle includes a first malleable portion. The first malleable portion includes a first internal core made of substantially rigid material that is bendable into various configurations and retains its shape after bending and a first outer layer made of material with sufficient flexibility to allow a wearer to adjust of the shape of the first handle. The handle also includes a first unmalleable portion. The first unmalleable portion includes a layer made of an unmalleable material that covers a portion of the first malleable portion of the handle in a portion of the first exposed length of the first handle. The first unmalleable portion is configured to curve around the axis of the first threading tube such that a center of the first unmalleable faces to a first lateral direction; wherein the ratio of the maximum opening distance to the first straight line length being at least 2:1 so as to allow for rotation of at least one of the handles. The container also includes a second handle, which is bendable and retains its shape after bending. The second handle is threaded through the second threading tube with a second threaded length of the second handle enclosed by the threading tube, a second straight line length between a third point on the second handle which coincides with a third end of the second threading tube and a fourth point on the second handle which coincides with a fourth end of the second threading tube, and a second exposed length of the second handle not enclosed by the threading tube. The second handle includes a second malleable portion which includes a second internal core made of substantially rigid material that is bendable into various configurations and retains its shape after bending; and a second outer layer made of material with sufficient flexibility to allow a wearer to adjust of the shape of the second handle. The second handle also includes a second unmalleable portion which includes a layer made of an unmalleable material that covers a portion of the second malleable portion of the handle in a portion of the second exposed length of the second handle. The second unmalleable portion is configured to curve around the axis of the second threading tube such that a center of the second unmalleable portion faces to a second lateral direction. The container is configured such that the first handle and the second handle can be moved into at least two positions in relation with each other by twisting the first handle. The first position is configured such that the first lateral direction of first unmalleable portion of the first handle faces the same direction as the second lateral direction of the second unmalleable portion of the second handle and nest together. The second position is configured such that the first lateral direction of first unmalleable portion of the first handle faces the opposite direction as the second lateral direction of the second unmalleable portion of the second handle.

In embodiments, the container can have at least one of the handles has a surface layer surrounding the outer layer.

In embodiments, the container includes a first handle and second handle that can be configured into a third position configured such that the first lateral direction of first unmalleable portion of the first handle faces the same direction as the second lateral direction of the second unmalleable portion of the second handle without nesting together such that the first and second handle fit comfortably over a person's shoulder.

In embodiments, the container includes a closure that extends through at least one of the handles and over the opening of the article storage assembly.

In embodiments, approximately 15% to 25% of the first handle is covered by the first threading tube.

In embodiments, the ratio of the maximum opening distance to the first straight line length is at least 3:1.

In embodiments, the first inner core is made of at least one of the metals selected from a group comprising copper, aluminum, stainless steel, steel, tin, brass, solder alloys, tin-silver-copper alloys, tin-copper-selenium alloys, lead free solder alloys, and zinc.

In embodiments, the first inner core comprises at least one of the polymers selected from a group comprising thermoplastic elastomer (TPE) and plastic composite.

In embodiments, a container is disclosed which includes an article storage assembly which includes a cavity for storage of one or more items and an opening and a first handle, which is bendable and retains its shape after bending, wherein the first handle includes a first malleable portion. The first malleable portion includes a first internal core made of substantially rigid material that is bendable into various configurations and retains its shape after bending; and a first outer layer made of material with sufficient flexibility to allow a wearer to adjust of the shape of the first handle. The first unmalleable portion includes a layer made of an unmalleable material that covers a portion of the first malleable portion of the handle, the first unmalleable portion configured to curve around the axis of the first side of the opening such that a center of the first unmalleable portion faces to a first lateral direction. The first handle is attached to the article storage assembly via an attachment which rotates freely. The container also includes a second handle, which is bendable and retains its shape after bending. The second handle includes a second malleable portion which includes a second internal core made of substantially rigid material that is bendable into various configurations and retains its shape after bending. The second handle also includes a second outer layer made of material with sufficient flexibility to allow a wearer to adjust of the shape of the second handle. The second unmalleable portion includes a layer made of an unmalleable material that covers a portion of the second malleable portion of the handle. the bag being configured such that the first handle can be moved into at least two positions in relation to the bag by twisting the first handle. The first position is configured such that the first lateral direction of first unmalleable portion of the first handle faces the same direction as the second lateral direction of the second unmalleable portion of the second handle and nest together. The second position is configured such that the first lateral direction of first unmalleable portion of the first handle faces the opposite direction as the second lateral direction of the second unmalleable portion of the second handle.

In embodiments, the container comprises an article storage assembly and a lid that is shapeable into various substantially rigid configurations.

DETAILED DESCRIPTIONS OF THE INVENTION

The present invention generally relates to bags with malleable handles. In the context of this patent, malleable is defined to mean that the of the shape of an object is adjustable to a particular shape, but sufficiently stiff or rigid such that the shape is maintained unless the user exerts a force to reshape the tubing. Users can shape the handle to desired individual personalized fit. In exemplary embodiments, at least one of the malleable handles includes an internal core of substantially rigid material that is bendable into various configurations, and an external layer around the internal core that provides additional advantages to the handle, such as, for example, improved aesthetics or comfort. The internal core may be made of flexible tubing or wire, such as, for example, metal (such as copper, aluminum, stainless steel, steel, tin, brass, solder alloys, tin-silver-copper alloys, tin-copper-selenium alloys, lead free solder alloys, or zinc, to name a few) or combination of metals (such as a combination of spring steel, copper, stainless steel and beryllium, to name a few), thermoplastic elastomer (TPE), or from a plastic composite, to name a few. The external layer may be made of, for example, vinyl or PVC tubing to name a few. In embodiments, the cross section of the internal core can be of varying thicknesses, such as for example, ranging from ⅛ inches to 2 inches and can be shapes such as round, oval, circular, square, rectangular, or triangular to name a few. In other embodiments, the cross section can be a thicker range of 2 inches to 7 inches. The cross section of the outer layer can also be shapes such as round, oval, circular, square, rectangular, or triangular to name a few. The shape of the cross section of the internal core and outer layer may be the same, and may be distinct. The malleability of the handle allows the handle to be integrated with and functionally cooperate with the other structural components of the bag or purse to provide a number of advantages. For example, as described in more detail herein, the handle can be deformed into a variety of shapes so that the handle can perform a number of functions, such as, for example, supporting the bag on a piece of furniture or other stationary item, or on a body part of the wearer other than the hand, arm, wrist, back (as a backpack), chest (as a front-pack) or shoulder. As a further example, the handle can be deformed to reconfigure the bag into different types of bags or purses (for example, from a clutch bag to a standard purse, or vice versa). As a further example, the handle can be split into more than one handle portion. Also, in exemplary embodiments, the handle can be lengthened or shortened as appropriate using a retractable feature. In exemplary embodiments, the handles can pivot up to 360 degrees.

An article storage assembly in accordance with the present invention can include bags such as purses, clutches, handbags, athletic bags, tennis bags, yoga bags, lunchboxes, maxi bags, mini bags, backpacks, frontpacks, baguette bags, bowling buckets, clutches, cosmetic bags, doctor's bags, EMT bags, cross-bodies, fanny packs, belt packs, double belt packs, duffel bags, envelopes, hobo bags, feed bags, fold over clutches, messenger bags, minaudieres, muff bags, saddle bags, satchels, shoulder bags, sling bags, totes, weekend bags, wristlets, glove bags, shopper bags, evening, wallets, beach bags, diaper bags, top handle bags, luggage, and makeup bags, water bottle holders, water bags, sports bags, and media bags to name a few, which can be adapted to use these malleable handles. Items other than bags such as yoga mats, ear warmers, earmuffs hats, water holders, and sports and athletics equipment, to name a few, could also be adapted to use these malleable handles.

In embodiments, that handle can be split into two handle portions. This enables users to hang the bag on their bodies in additional configurations, providing further safety and convenience.

The inventors have found that unique configurations of handles have resulted in unexpected advantages. The malleable handles can also be adjusted by the user to be able to hang on various surfaces, including furniture such as tables, chairs, chair arms, chair backs, transportation chair backs, to name a few or the user's body parts including knees, thigh, lap (either to the side of a wearer's leg or in between a wearer's legs), arms and/or shoulders, chest (as a frontpack), back (as a backpack) to name a few. This provides the user with options for where to place the bag when it is not in use, thereby allowing the user to place the bag in a location that is likely to reduce the chance of the bag being stolen or dirtied. Furthermore, the malleable tubing can also be conformed the user's body, which results in a more comfortable wear. The malleable tubing also allows the bag to be more conveniently stored. Embodiments of this invention are especially beneficial to wearing the bag as a backpack because as opposed to prior art backpacks, the handle provides a way to wear a backpack while not encumbering the under arms.

FIGS. 1-21C illustrate exemplary embodiments of the present invention which achieve particular advantages not present in prior art bags.

FIG. 1 shows a bag according to an exemplary embodiment of the invention. The bag 118 includes an article storage assembly 100, and one handle 106. The article storage assembly 100 includes an opening 116 through which items may be passed for storage inside the article storage assembly 100. The article storage assembly 100 is shown in FIG. 1 as including a single pouch and opening. However, it should be appreciated that the article storage assembly 100 may include, for example, a combination of pouches, folds, clasps, buttons, and opening to allow for storage of articles of varying size and weight.

In FIG. 1, the handle 106 is made up of a first handle portion 104 and second handle portion 112. The first handle portion 104 has a first end 108, and a second end 118. The second handle portion 112 has a first end 110, and a second end 120. The second end 118 of the first handle portion 104 is detachably secured to the article storage assembly 100, via suitable connection 102 such as, for example, a clasp. The second end 120 of the second handle portion 112 is detachably secured to the article storage assembly 100, via suitable connection 114, such as, for example, a clasp. Alternate connections could be pressure connections, zippers, zipper-sliders, buttons, folding connections, slide connections, friction connections, latches, magnets, snaps, clasps, buckles, toggles, corded ties, ribbons, twist connections, grommets, bolts, pins, safety pins, to name a few. A folding connection can include a malleable handle placed within a secured ring and folding the handle such that it is the ring will be held in place via gravity, or the like. A friction connection can include a malleable handle inserted in a hold that is tight enough to create sufficient friction to prevent the handle from sliding out. The first end 108 of the first handle portion 104 and the first end 110 of the second handle portion 112 are removably attached to each other by suitable connection such as, for example, a clasp. Alternate connections could be pressure connections, zippers, zipper-sliders, buttons, folding connections, slide connections, friction connections, latches, magnets, snaps, clasps, buckles, toggles, corded ties, ribbons, twist connections, grommets bolts pins, safety pins to name a few.

In embodiments, the second end 118 of the first handle portion 104 can be fixedly secured to the article storage assembly via suitable connections such as clasps, ties, or sewing to name a few.

In embodiments, the second end 120 of the second handle portion 112 can be fixedly secured to the article storage assembly via suitable connections such as clasps, ties, or sewing to name a few.

In embodiments, the handle 106 is made of malleable tubing into various substantially rigid configurations. Malleable tubing comprises one or more inner core materials, such as a metal (such as copper, aluminum, stainless steel, steel, tin, brass, solder alloys, tin-silver-copper alloys, tin-copper-selenium alloys, lead free solder alloys, or zinc, to name a few) or combination of metals (such as a combination of spring steel, copper, stainless steel and beryllium) or from a plastic composite, and one outer layer material such as vinyl or PVC tubing, that have sufficient flexibility, such that a user may adjust of the shape of tubing to a particular shape, but that are sufficiently stiff or rigid such that the shape is maintained unless the user exerts a force to reshape the tubing. As another example, malleable tubing may be formed from a material having elastic properties such as a thermoplastic elastomer (TPE) and more specifically an extruded TPE, which include copolymers or a physical mix of polymers (usually a plastic and a rubber) which consists of materials with both thermoplastic and elastomeric properties. Reinforcement fibers can also be used to add strength to the tubing.

The embodiment shown in FIG. 1 enables users to carry the bag with the malleable handle 106 comfortably curved to their shoulders. Furthermore, users can wrap the handle 106 around their knee, knees, thigh (with the bag in between or below the user's legs), or leg (with the bag hanging off the side of the user's leg) while sitting to prevent theft. Users can also detach the handle portions 104, 112 to wrap the handle portions around their knee, knees, thigh (with the bag in between or below the user's legs), or leg (with the bag hanging off the side of the user's leg) in additional configurations.

In embodiments, the bag is as shown in FIG. 1 except instead of attaching the handle portions 104, 112 to the article storage assembly 100, via connections 102, 114, the second ends of each handle portion 118, 120 continue into the article storage assembly 100, and are removably attached to each other.

In embodiments, the malleable tube may be covered by other materials. These materials may be rigid, such as metals, plastics, bamboo, Bakelite, wood, to name a few. The covering materials may also be malleable such as PVC, plastic, fabric, leather, vinyl, neoprene, woven fur, celluloid, sheepskin, to name a few.

Figure 1A:
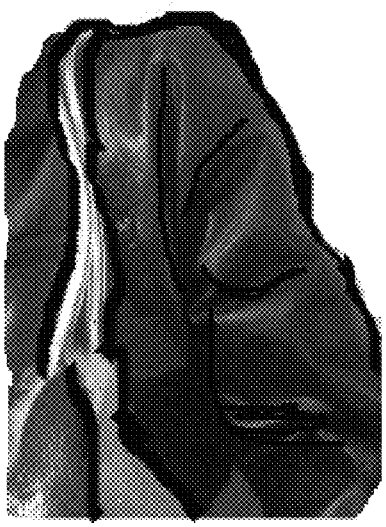
FIG. 1A shows a photograph of the bag according to an exemplary embodiment of the invention being worn.

FIG. 1A is a photograph of the bag of the embodiment of FIG. 1 with malleable handle being worn on a shoulder, emphasizes the conforming nature of the malleable handle which makes for a comfortable wear.

Figure 1B:
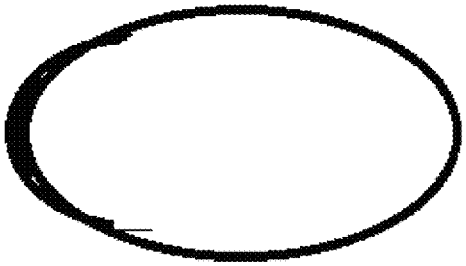
FIG. 1B shows a photograph of a bag strap according to an exemplary embodiment of the invention.

FIG. 1B is a photograph of an exemplary embodiment of the malleable handle.

Figure 1C:
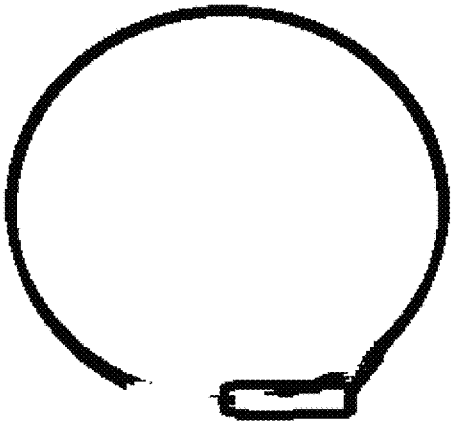
FIG. 1C shows a photograph of a bag strap connection in an open configuration according to an exemplary embodiment of the invention.

FIG. 1C is a photograph of an exemplary embodiment of the pressure connection used to removably connect the handle portions 104 112 in an open configuration.

Figure 1D:
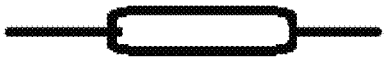
FIG. 1D shows a photograph of a bag strap connection in an closed configuration according to an exemplary embodiment of the invention.

FIG. 1D is a photograph of an exemplary embodiment of the pressure connection used to removably connect the handle portions 104 112 in a closed configuration.

Figure 2:
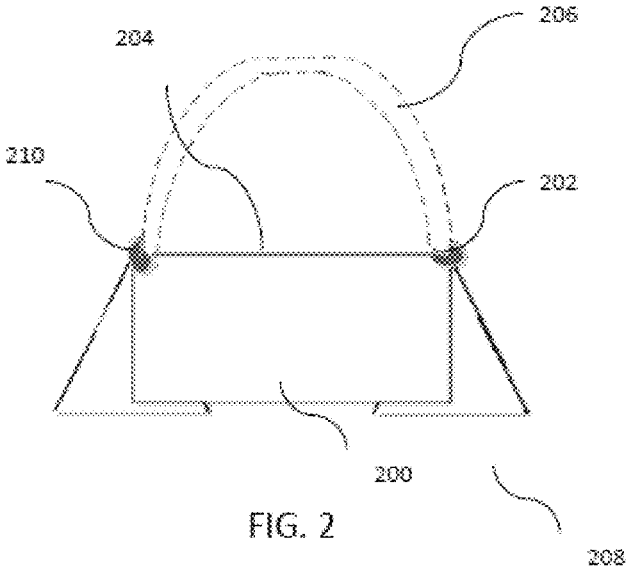
FIG. 2 shows a bag according to an exemplary embodiment of the invention.

FIG. 2 shows a bag according to an exemplary embodiment of the invention. The bag 208 includes an article storage assembly 200, an opening 204, and at least one handle 206. The handle 206 is made of malleable tubing as described for the embodiment of FIG. 1.

The handle comprises at least two ends 202, 210 which are removably secured to the article storage assembly via suitable connection as described above for the embodiment of FIG. 1.

In embodiments, the two ends 202, 210 of the handle 206 can be fixedly secured to the article storage assembly 200 via a suitable connection as described for the embodiment of FIG. 1.

In some exemplary embodiments, the second end of handle 210 can be fixedly secured to the article storage assembly 200 via a suitable connection as described for the embodiment of FIG. 1.

The embodiment shown in FIG. 2 enables users to carry the bag with the malleable handle 206 comfortably curved to their shoulders. Furthermore, users can wrap the handle 206 around their knee, knees, thigh (with the bag in the user's lap), or leg (with the bag hanging off the side of the user's leg) while sitting, to prevent theft.

In embodiments, the bag is as shown in FIG. 2 the handle ends 202, 210 connect removably or fixedly to each other within the article storage assembly 200.

Figure 3A:
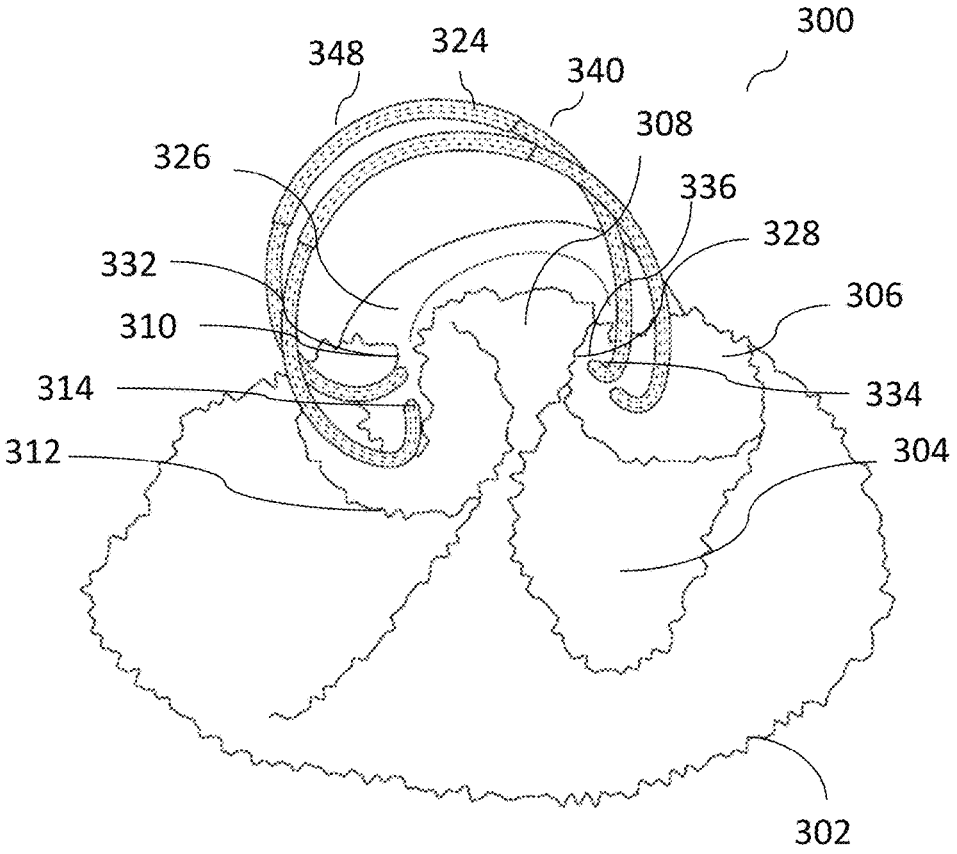
FIG. 3A shows a top perspective view of a bag with the handles in a first position according to an exemplary embodiment of the invention.
Figure 3B:
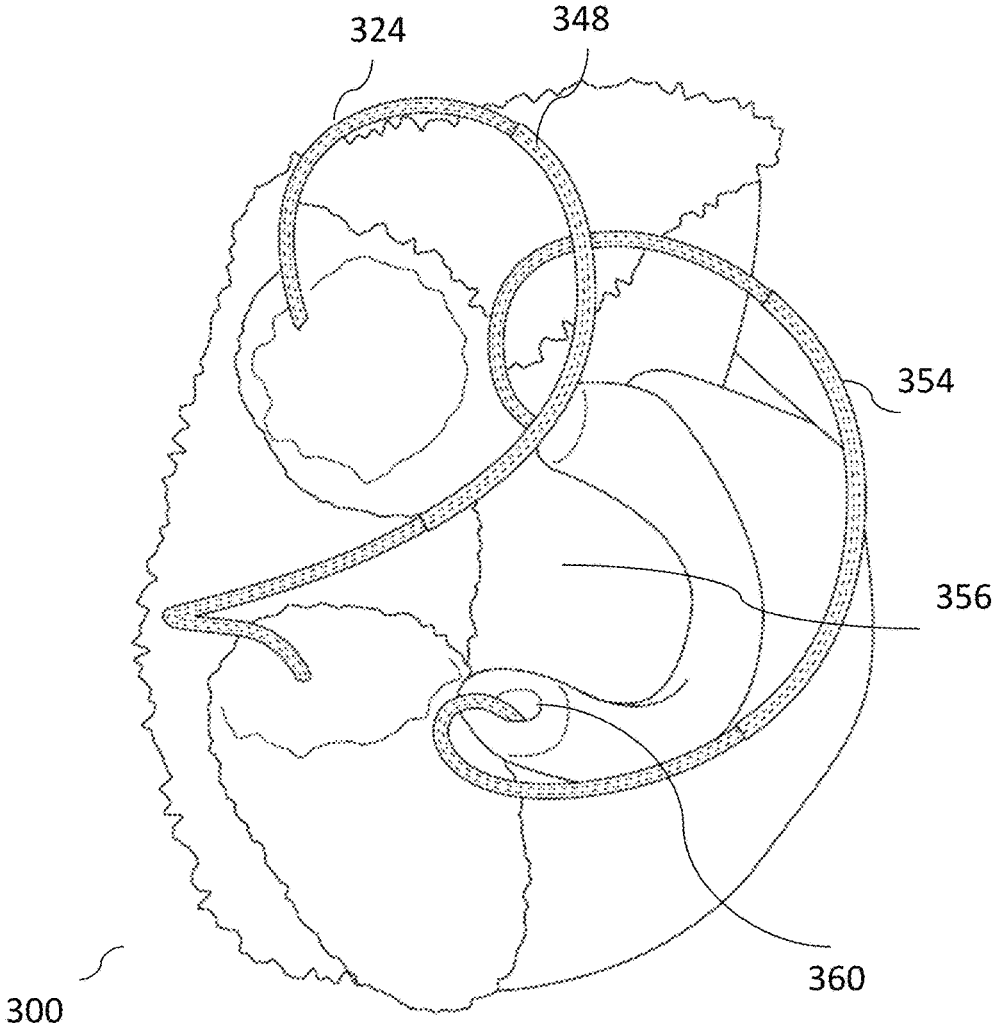
FIG. 3B shows a top perspective view of a bag with the handles in a second position according to an exemplary embodiment of the invention.
Figure 3C:
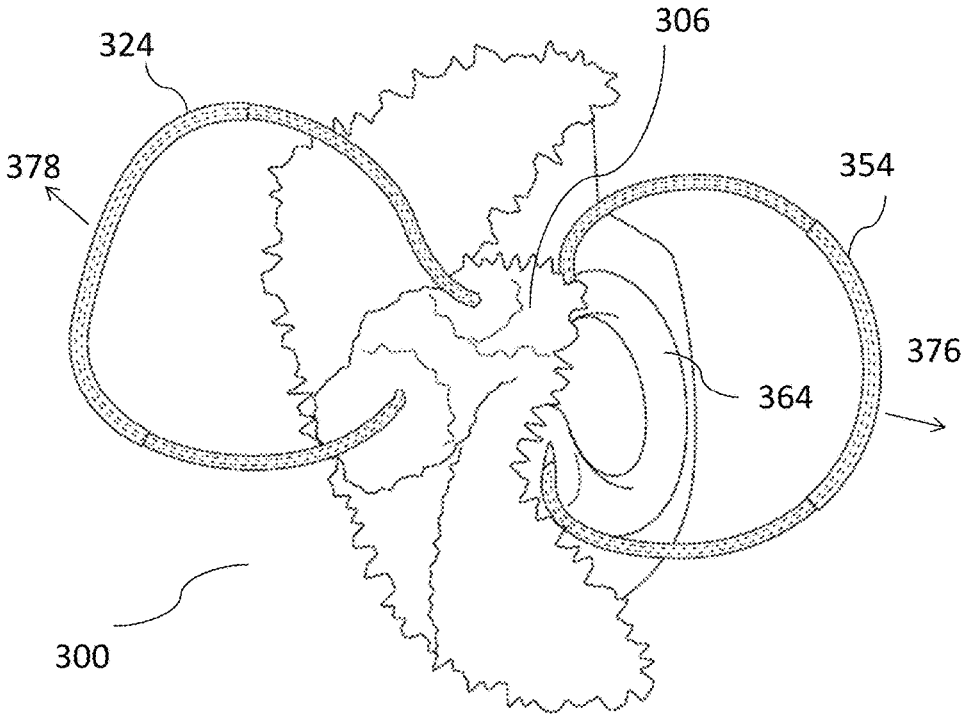
FIG. 3C shows a top perspective view of a bag with the handles in a third portion according to an exemplary embodiment of the invention.

FIGS. 3A through 3C shows a front, side, and top view of a container 300 in accordance with the invention which includes an article storage assembly 302. The article storage assembly 302 includes a cavity 304 for storage of one or more items and an opening 306. In embodiments, the article storage assembly may include purses, clutches, handbags, athletic bags, tennis bags, yoga bags, lunchboxes, maxi bags, mini bags, backpacks, frontpacks, baguette bags, bowling buckets, clutches, cosmetic bags, doctor's bags, EMT bags, cross-bodies, fanny packs, belt packs, double belt packs, duffel bags, envelopes, hobo bags, feed bags, fold over clutches, messenger bags, minaudieres, muff bags, saddle bags, satchels, shoulder bags, sling bags, totes, weekend bags, wristlets, glove bags, shopper bags, evening, wallets, beach bags, diaper bags, top handle bags, luggage, and makeup bags, water bottle holders, water bags, sports bags, and media bags to name a few, and can be adapted to use malleable handles in accordance with the present invention. In embodiments, items other than bags such as yoga mats, ear warmers, earmuffs hats, water holders, and sports and athletics equipment, to name a few, may also be used with malleable handles in accordance with the present invention.

Referring to FIGS. 3A through 3C, the opening 306 has a first side of the opening 308 with at least a portion of the first side including a first threading tube 310. The opening 306 also has a second side of the opening 312 in which at least a portion of the second side includes a second threading tube 314. In embodiments, other forms of threading tube can be included such as knit, crocheted, slip knotted, woven, twisted, braided, back tacked, backstitched, basting stitched, blanket stitched, hemstitched, buttonhole stitched, chain stitched, cross-stitched catch stitched, darning stitched, embroidery stitched, overcast stitched, pad stitched, pick stitched, rantered, running stitched, sailmakers stitched, slip stitched, stated, tacked, tent stitched, topstitched, whipstitched, straight stitched, zigzag stitched, sating stitched, outline stitched, running stitched, to name a few. In embodiments, the threading tube can also be made of rings of various cross sections including circular, oval, triangular, or rectangular.

Further, continuing to refer to FIGS. 3A through 3C, the opening 306 has a variable opening distance 316 with a maximum opening distance 318 between a center of the first side 320 and a center of second side 322.

The container also includes a first handle 324, which is bendable and retains its shape after bending. As shown in FIGS. 3A through 3C, the first handle 324 is threaded through the first threading tube with a first threaded length 326 of the first handle enclosed by the threading tube. For example, in embodiments, 15% to 25% of the entire length of the first handle 324 is covered by the first threading tube 310. In embodiments, 25% to 45% of the entire length of the first handle 324 is covered by the first threading tube 310. In embodiments, 45% to 65% of the entire length of the first handle 324 is covered by the first threading tube 310.

Further, continuing to refer to FIGS. 3A through 3C, the first handle 324 has a first straight line length 328 between a first point on the first handle 330 which coincides with a first end of the first threading tube 332 and a second point on the first handle 334 which coincides with a second end of the first threading tube 336, and a first exposed length of the first handle 338 not enclosed by the threading tube. For example, the ratio of the maximum opening distance to the first straight line length being at least 2:1 so as to allow for rotation of at least one of the handles. In embodiments, the ratio of the maximum opening distance to the first straight line length can be 3:1 or even larger.

Referring further to FIGS. 3A through 3C, the first handle 334 includes a first malleable portion 340. The first malleable portion 340 includes a first internal core 344 made of substantially rigid material that is bendable into various configurations and retains its shape after bending and a first outer layer 346 made of material with sufficient flexibility to allow a wearer to adjust of the shape of the first handle. In embodiments, the first inner core is made of at least one of the metals such as copper, aluminum, stainless steel, steel, tin, brass, solder alloys, tin-silver-copper alloys, tin-copper-selenium alloys, lead free solder alloys, and zinc, to name a few. In embodiments, the first internal core 324 comprises at least one of the polymers, such as, thermoplastic elastomer (TPE) and plastic composite, to name a few. The first handle 334 also includes a first unmalleable portion 348. In embodiments, the container can have at least one of the handles 324 or 354 has a surface layer surrounding the outer layer.

Referring further to FIGS. 3A through 3C, the first unmalleable portion 348 includes a layer made of an unmalleable material 350 that covers a first surface portion of the first malleable portion of the handle in a portion of the first exposed length of the first handle. In embodiments, the first unmalleable portion 348 covers between 10% and 35% of the first exposed length of the handle. In embodiments, the first unmalleable portion 348 covers between 35% and 50% of the first exposed length of the handle. In embodiments, the first unmalleable portion 348 covers between 50% and 65% of the first exposed length of the handle. The first unmalleable portion as shown is configured to curve around the axis of the first threading tube such that a center of the first unmalleable faces 352 to a first lateral direction 378, wherein the ratio of the maximum opening distance 318 to the first straight line length 328 being at least 2:1 so as to allow for rotation of at least one of the handles. In embodiments, the ratio of the maximum opening distance to the first straight line length can be 3:1 or even greater.

In accordance with exemplary embodiments of the present invention, the container, shown in FIGS. 3A through 3C, also includes a second handle 354, which is bendable and retains its shape after bending. The second handle is threaded through the second threading tube with a second threaded length of the second handle enclosed by the threading tube, a second straight line length 356 between a third point on the second handle 358 which coincides with a third end of the second threading tube 360 and a fourth point on the second handle 362 which coincides with a fourth end of the second threading tube 364, and a second exposed length of the second handle not enclosed by the threading tube.

Further referring to FIGS. 3A to 3C, the second handle 358 includes a second malleable portion 366 which includes a second internal core 368 made of substantially rigid material that is bendable into various configurations and retains its shape after bending; and a second outer layer 370 made of material with sufficient flexibility to allow a wearer to adjust of the shape of the second handle. The second handle 358 also includes a second unmalleable portion 372 which includes a layer made of an unmalleable material that covers a portion of the second malleable portion of the handle in a portion of the second exposed length of the second handle. The second unmalleable portion is configured to curve around the axis of the second threading tube such that a center of the second unmalleable portion 374 faces to a second lateral direction 376. In embodiments, the container includes a closure that extends through at least one of the handles 324 and 354 and over the opening of the article storage assembly.

The container is configured such that the first handle 324 and the second handle 354 can be moved (or twisted) into at least two positions in relation with each other by twisting the first handle in relation to the second handle. Referring to FIG. 3A, a first position is configured such that the first lateral direction 378 of first unmalleable portion of the first handle faces the same direction as the second lateral direction 376 of the second unmalleable portion of the second handle and nest together. Referring to FIG. 3C, a second position is configured such that the first lateral direction 378 of first unmalleable portion of the first handle faces the opposite direction as the second lateral direction 376 of the second unmalleable portion of the second handle. In use, as illustrated with, for example, FIGS. 3E and 3F, the handles may be positioned so that the bag may be hanging on one user's legs, either with the bag between the users' legs, as shown in FIG. 3F, or the bag hanging off the side of the users' leg as shown in FIG. 3E. When configured to this position, a user may also easily carry the bag or wear the bag to side of their legs while sitting for comfort and safety. FIG. 3E shows the container with the handles twisted into in the second position with the container with a user wearing the container on the user's legs with the container falling between the user's legs. This position allows a user to sit comfortably and protect the container easily and effortlessly.

A key benefit of the bags shown in FIGS. 3A through 3H is that it can be configured by twisting the handles in to multiple different positions, thus in some positions allowing the user to comfortably carry the bag, while in other positions allowing the user to store the bags while sitting in comfortable and/or safe positions. To transition from one of these configurations to another, the user can twist the first handle 324 in relation to the second handle 358. FIG. 3B shows the bag in a configuration in which the first handle 324 and second handle 358 are pointed in the same direction and nested. FIG. 3C shows the first handle 324 and second handle 358 after having been twisted to be pointing in opposite directions. To make this change, the user twists the first handle 324 approximately 180 degrees with respect to the second handle 358 to face the other direction. In doing so, the first threading tube and part of the container twist with it.

Similarly, to move the container back from the position shown in FIG. 3C to the position shown in FIG. 3B, the user twists the first handle 324 with respect to the second handle 358 in the reverse direction. By twisting in the reverse direction the threading tube and side of the bag are preventing from twisting to an extent at which they are unusable.

Figure 3D:
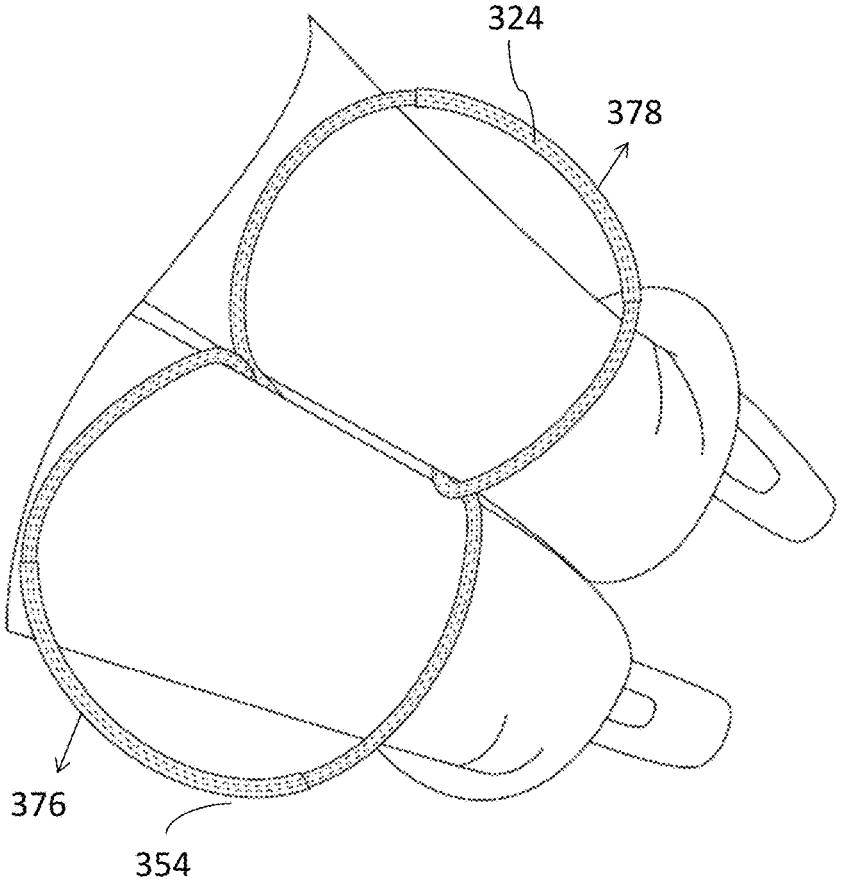
FIG. 3D shows a top view of a bag being worn in a first position over a user's legs according to an exemplary embodiment of the invention.
Figure 3E:
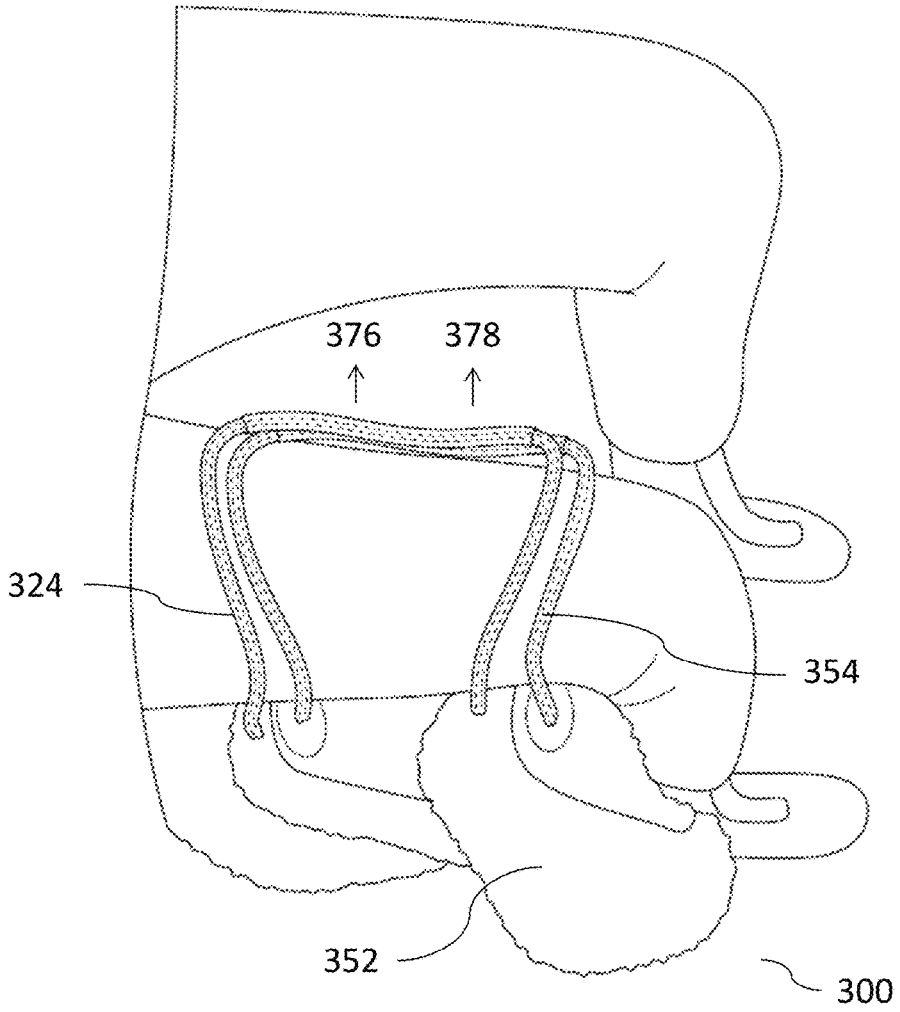
FIG. 3E shows a side view of a bag being worn in a second position over a user's legs according to an exemplary embodiment of the invention.
Figure 3F:
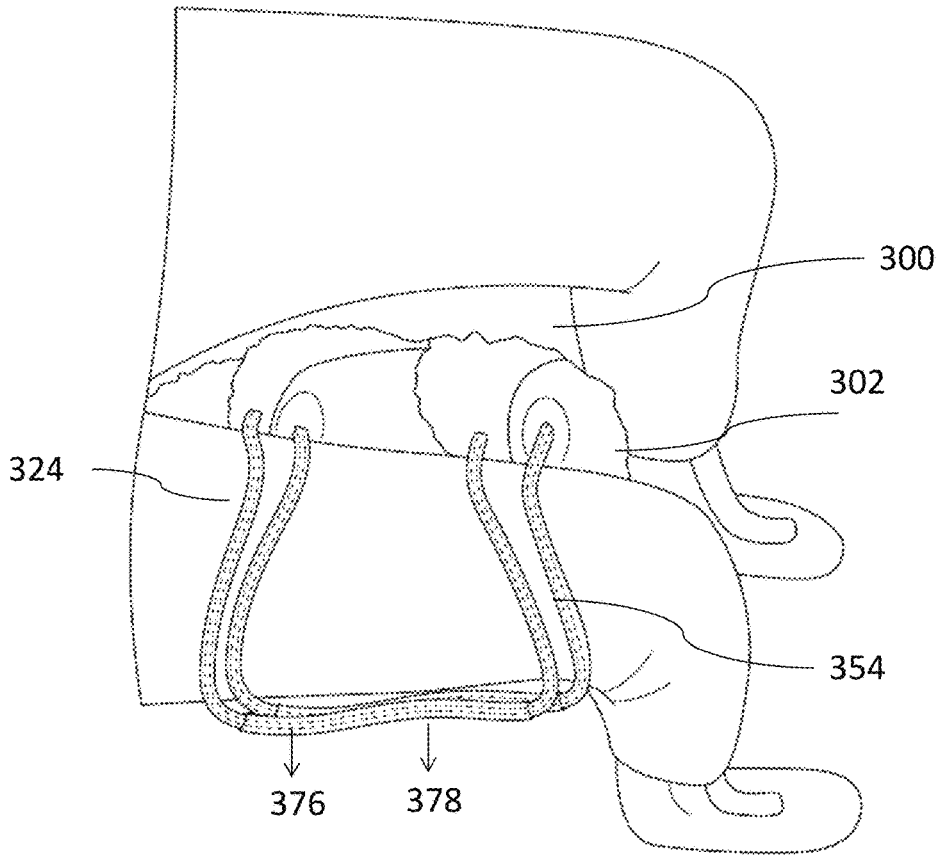
FIG. 3F shows a side view of a bag being worn in a third position over a user's legs according to an exemplary embodiment of the invention.
Figure 3G:
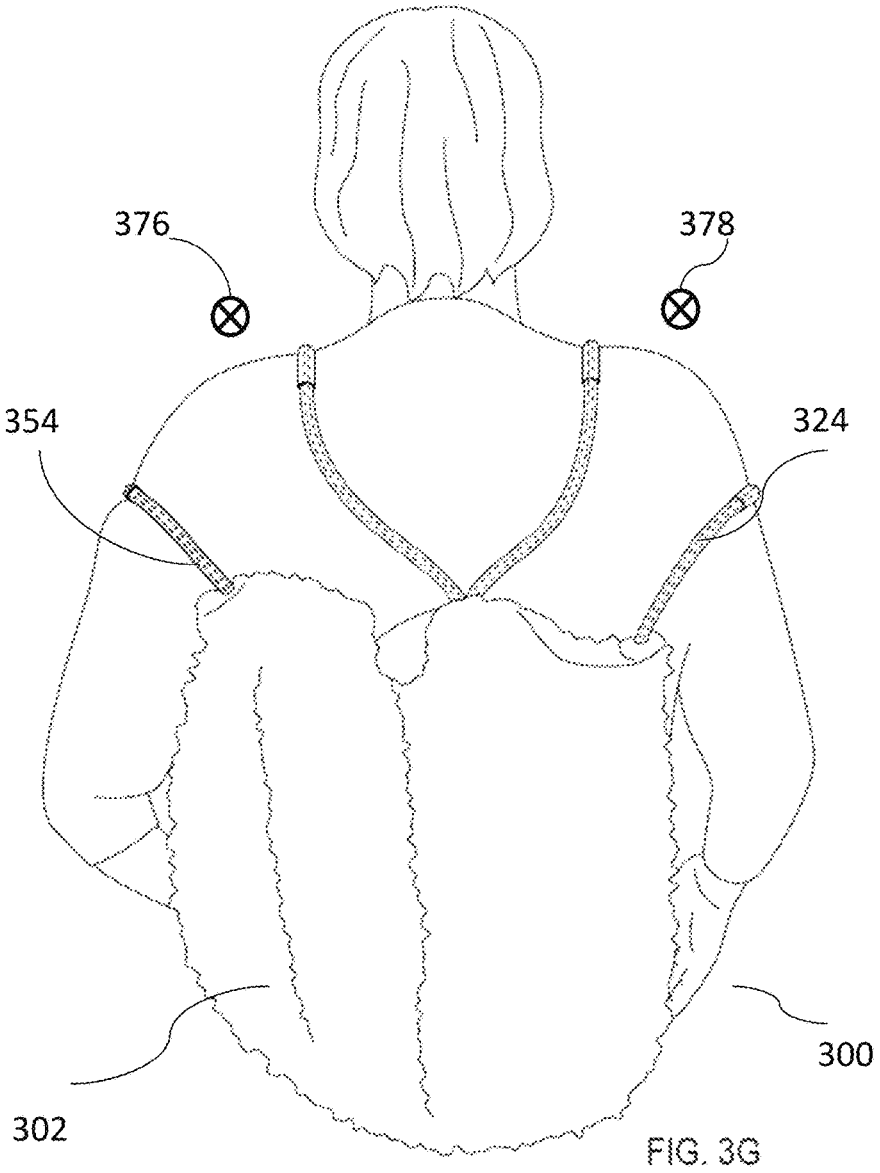
FIG. 3G shows a back view of a bag being worn in a fourth position over a user's back according to an exemplary embodiment of the invention.

FIG. 3G shows a third configuration in which the first handle 324 and second handle 358 are pointed in the same direction but not nested. To configure the bag this way from an initial position shown in FIG. 3C, the user twists the first handle 324 approximately 90 degrees either clockwise or counterclockwise while also twisting the second handle 358 approximately 90 degrees in the opposite direction as the first handle 324 (e.g., twisting the second handle counterclockwise if the user has twisted the first hand clockwise). To obtain this configuration from an initial position as shown in FIG. 3B, the user twists both handles approximately 90 degrees in the same direction (e.g., either both clockwise or both counterclockwise).

FIG. 3D shows a cross section of the first handle 324. The first internal core 344, first outer layer 346 and unmalleable portion 348 are all visible in this view. The first internal core 344 provides the sufficient structure to enable the handle to remain in whatever shape the user moves it to. The first outer layer 346 provides protection and comfort fort the user. The first unmalleable portion 348 enables the twisting motion described below which allows the different configurations described above.

Figure 3H:
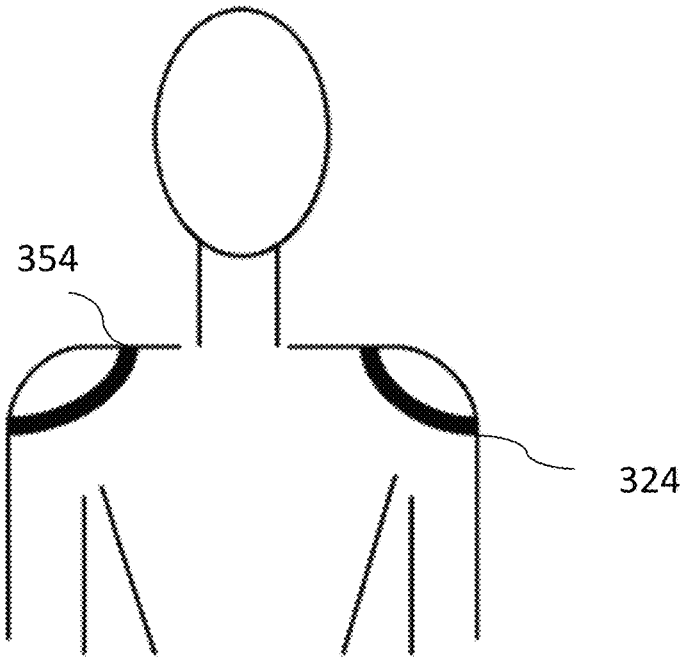
FIG. 3H shows a front view of the bag from FIG. 3G being worn in the fourth position over a user's back according to an exemplary embodiment of the invention.

FIG. 3G shows the bag being configured to allows a user wearing the container over his or her shoulders. Carrying a bag on one's shoulders enables a more even distribution of weight that can help a person's posture and musculature, especially when the handles naturally molded to the form of the user's body. Furthermore, a bag that can be worn in this manner and carried on one's hand or one's lap while molding to the body is unique to this invention. FIG. 3G shows the first lateral direction 378 and second lateral direction 376 using a circle with an X to indicate the direction is into the page. FIG. 3H shows the front view of a user wearing the container over his or her shoulders.

In embodiments, the container shown in FIGS. 3A-H can be configured such that the second position is configured such that the first lateral direction of first unmalleable portion of the first handle faces the same direction as the second lateral direction of the second unmalleable portion of the second handle without nesting together so as to fit comfortably on a person's shoulders.

In embodiments, the container includes a first handle 324 and second handle 354 that can be configured into a third position configured such that the first lateral direction 378 of first unmalleable portion of the first handle 324 faces the same direction as the second lateral direction 376 of the second unmalleable portion of the second handle 354 without nesting together such that the first and second handle fit comfortably over a person's shoulder.

Figure 22A:
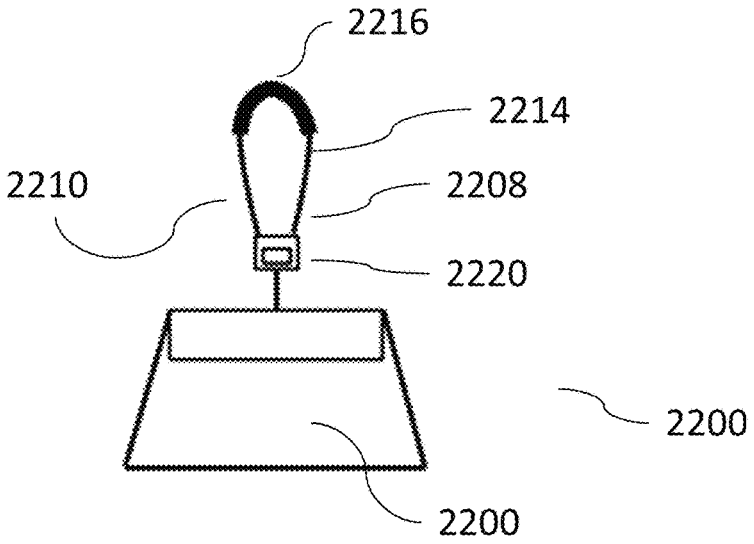
FIGS. 22A-C show a bag according to an exemplary embodiment of the invention.
Figure 22B:
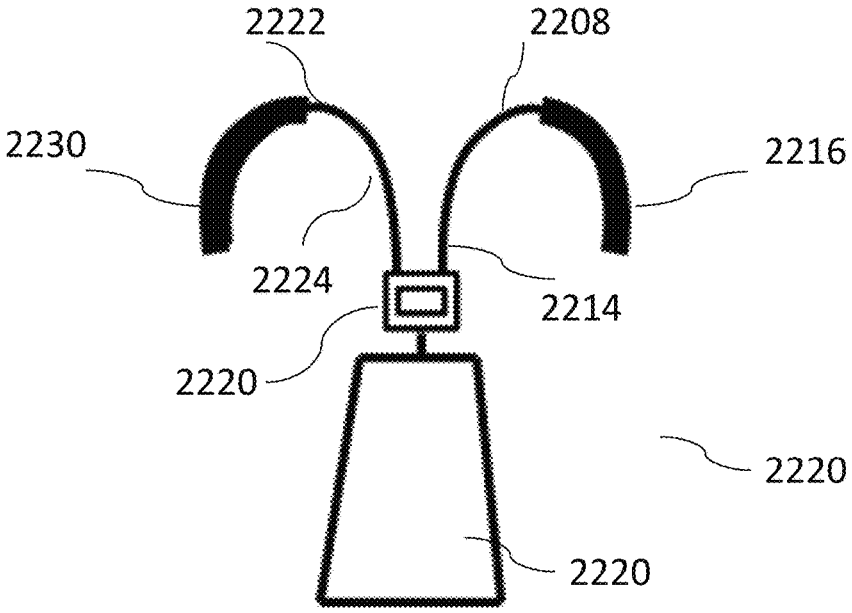
Figure 22C:
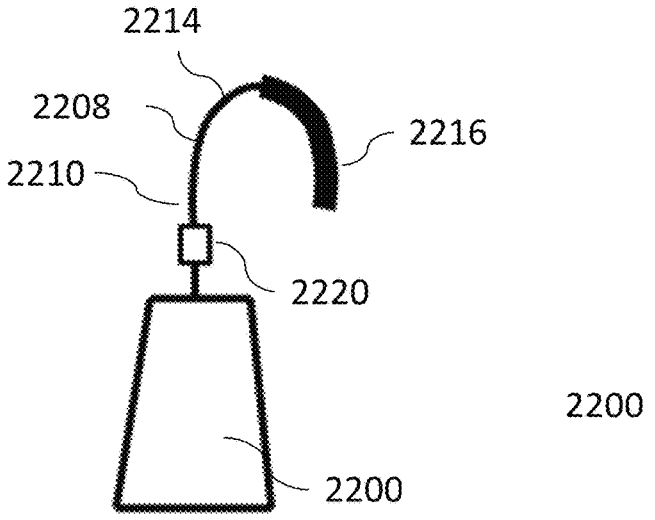

In another embodiment shown in FIGS. 22A-22C, a container 2200 which includes an article storage assembly 2202 which includes a cavity 2204 for storage of one or more items and an opening 2206 and a first handle 2208, which is bendable and retains its shape after bending, wherein the first handle 2208 includes a first malleable portion 2210. The first malleable portion 2210 includes a first internal core 2212 made of substantially rigid material that is bendable into various configurations and retains its shape after bending; and a first outer layer 2214 made of material with sufficient flexibility to allow a wearer to adjust of the shape of the first handle 2208. The first handle also includes a first unmalleable portion 2216. The first unmalleable portion 2216 includes a layer made of an unmalleable material that covers a portion of the first malleable portion of the handle 2210, the first unmalleable portion 2216 configured to curve around the axis of the first side of the opening such that a center of the first unmalleable portion 2216 faces to a first lateral direction 2218. The first handle is attached to the article storage assembly 2202 via an attachment 2220 which rotates freely. In embodiments, the attachment can be a buckle, a zipper, a button, elastic, ribbing, a rhinestone, a notion, a rivet, a press rivet, a grommet, a nailhead, a turnlock, a foot and stud, a toggle, a magnet, a snap, a swivel, an O-ring, a D-ring, a square ring, a metal slider, a clasp, a snap, or a hook and eye closure, to name a few.

The container may also include a second handle 2222, which is bendable and retains its shape after bending. The second handle includes a second malleable portion 2224 which includes a second internal core 2226 made of substantially rigid material that is bendable into various configurations and retains its shape after bending. The second handle also includes a second outer layer 2228 made of material with sufficient flexibility to allow a wearer to adjust of the shape of the second handle. The second unmalleable portion 2230 includes a layer made of an unmalleable material that covers a portion of the second malleable portion of the handle.

The bag in accordance with these embodiments may be configured such that the first handle can be moved into at least two positions in relation to the bag by twisting the first handle. The first position is configured such that the first lateral direction of first unmalleable portion of the first handle faces the same direction as the second lateral direction of the second unmalleable portion of the second handle and nest together. The second position is configured such that the first lateral direction of first unmalleable portion of the first handle faces the opposite direction as the second lateral direction of the second unmalleable portion of the second handle.

Figure 4:
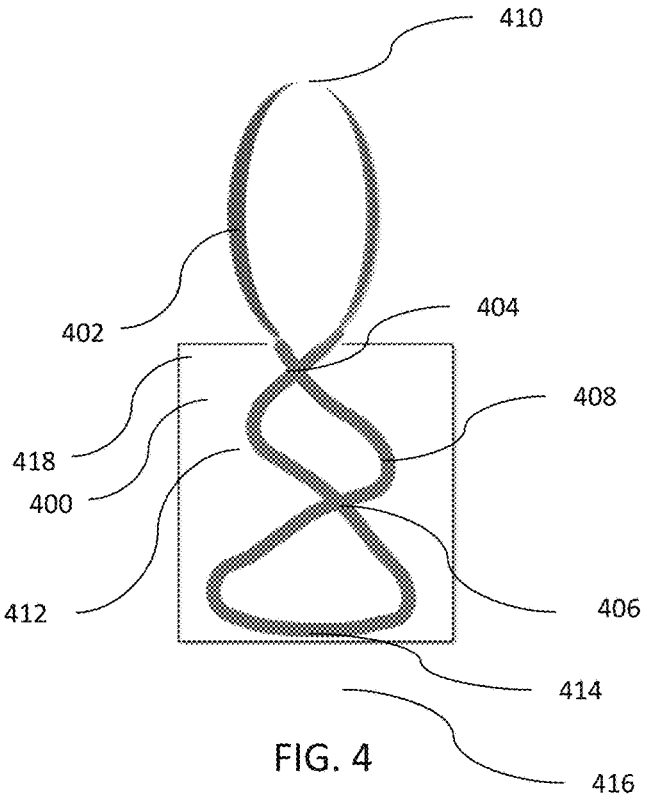
FIG. 4 shows a bag according to an exemplary embodiment of the invention.

FIG. 4 shows a bag according to another exemplary embodiment of the invention. The bag 416 includes an article storage assembly 400, an opening 418, at least one handle 402, made of malleable tubing as described for the embodiment of FIG. 1, in the shape of a closed loop and consisting of pull points 408, 410, 412, 414. The handle 402 is fixed to the article storage assembly 400 to at least two nodes 404, 406 and threaded through the nodes so that it crosses at the nodes.

This pattern of threading the handle 402 through the nodes 404, and 406 may enable the handle 402 to be pulled laterally at pull points 408 and 412, or vertically at pull points 410 and 414.

The exemplary embodiment shown in FIG. 4 enables users to carry the bag 414 in a number of positions. Furthermore, it enables users to hang the bag on a number of common objects, including tables and chairs, from a plurality of different locations on the handle 402, including the pull points 408, 410, 412, 414.

Figure 5:
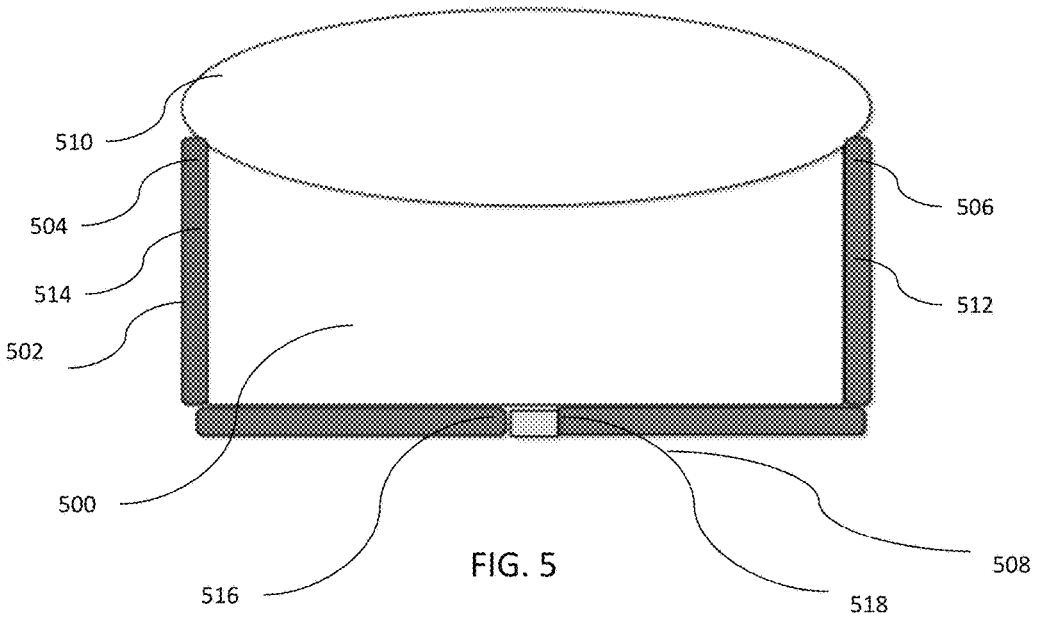
FIG. 5 shows a bag according to an exemplary embodiment of the invention.

FIG. 5 shows a bag according to another exemplary embodiment of the invention. The bag 508 includes an article storage assembly 500, an opening 510, and at least one handle 502 made of malleable tubing as described for the embodiment of FIG. 1, fixed to the article storage assembly 500 via at least two fix points 504, 506.

The handle 502, comprising two handle portions 514 and 512, may be secured to the article storage assembly 500 at fixed points 504, 506 via a suitable connection as described for the embodiment in FIG. 1.

Figure 5A:
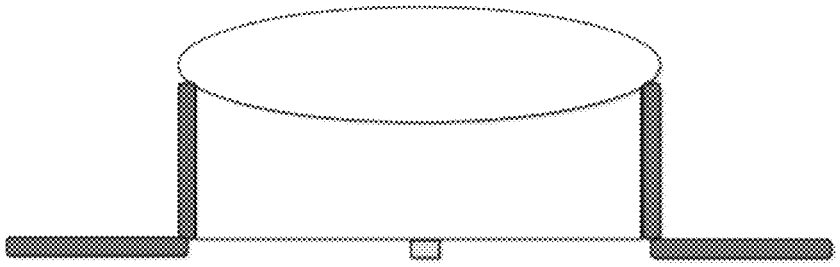
FIG. 5A shows the bag of FIG. 5 with handle portions in an open configuration.

The handle portions 514 and 512 are removably attached to each other at ends opposite the second ends 516, 518. When detached the handles can move to the side, as shown in FIG. 5A.

In embodiments, the handle 502 may be secured to the article storage assembly 500 at fixed points 504, 506 via a rotatable connection.

In embodiments the bag is as shown in FIG. 5 except the handle 502 does not fix to the article storage assembly 500 via fixed points 504, 506, and instead, the ends of the handle 502 continue into the bag, and removably attach to each other.

The embodiment shown in FIG. 5, enables the user to use the handle 502 as a handle, or to tuck the handle securely around the article storage assembly 500 for storage. Furthermore, the handle 502, can be placed in many alternate arrangements which enables users to hang it from commonplace items.

Figure 6:
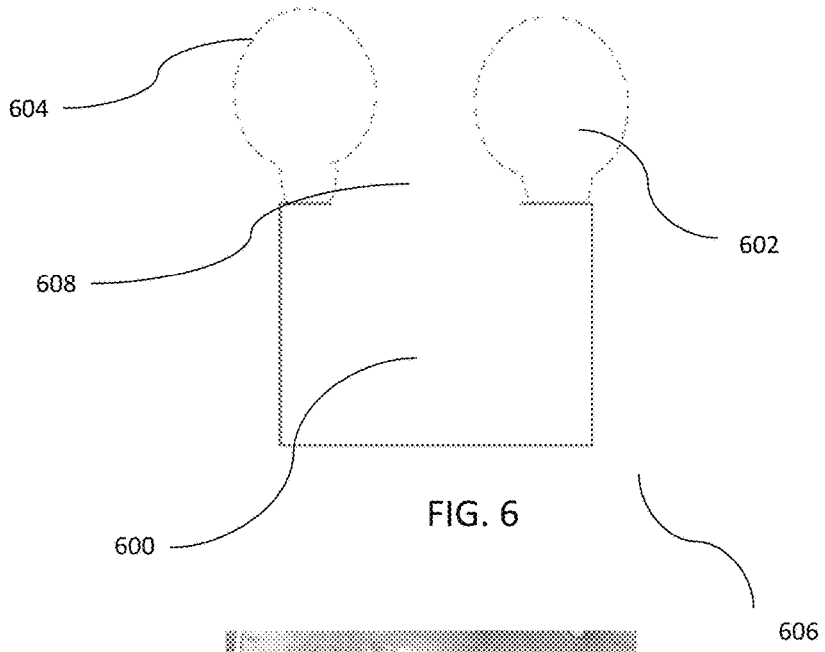
FIG. 6 shows a bag according to an exemplary embodiment of the invention.

FIG. 6 shows a bag according to another exemplary embodiment of the invention. The bag 606 includes an article storage assembly 600, an opening 608, and at least two handles 602 and 604, made of malleable tubing as described for the embodiment of FIG. 1.

In FIG. 6, each handle 602, 604, may be shaped as a complete loop with a curve around a diameter.

In embodiments, the handles 602, 604 may be partially rigid.

In embodiments, the handles 602, 604 may be partial loops that have ends that attach to the article storage assembly via suitable connection.

Figure 6A:
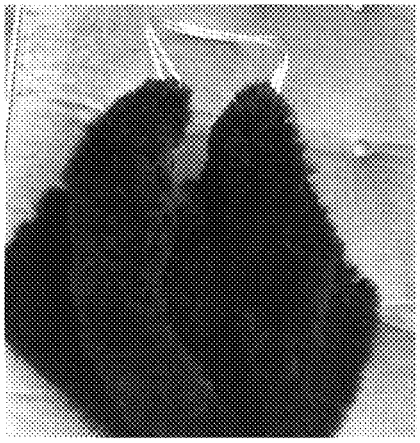
FIG. 6A shows a photograph according to the exemplary embodiment of the invention of FIG. 6.
Figure 6B:
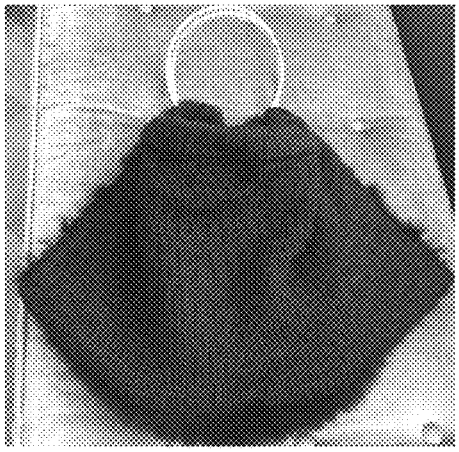
FIG. 6B shows a photograph according to the exemplary embodiment of the invention of FIG. 6.
Figure 6C:
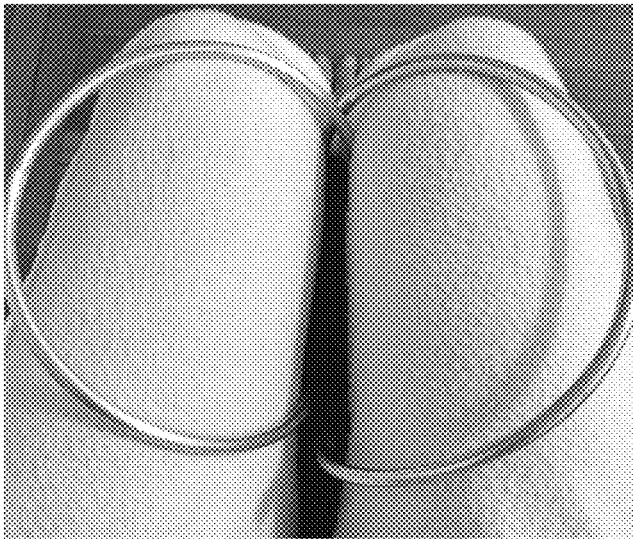
FIG. 6C shows a photograph according to the exemplary embodiment of the invention of FIG. 6.

The embodiment shown in FIG. 6 enables users to seal the bag by twisting the handles 602 and 604 so that their curves align (as shown in FIGS. 6A and 6B). It further allows users to hang the bag via the curved loops in the handles 602 and 604 (as shown in FIG. 6C).

Figure 7A:
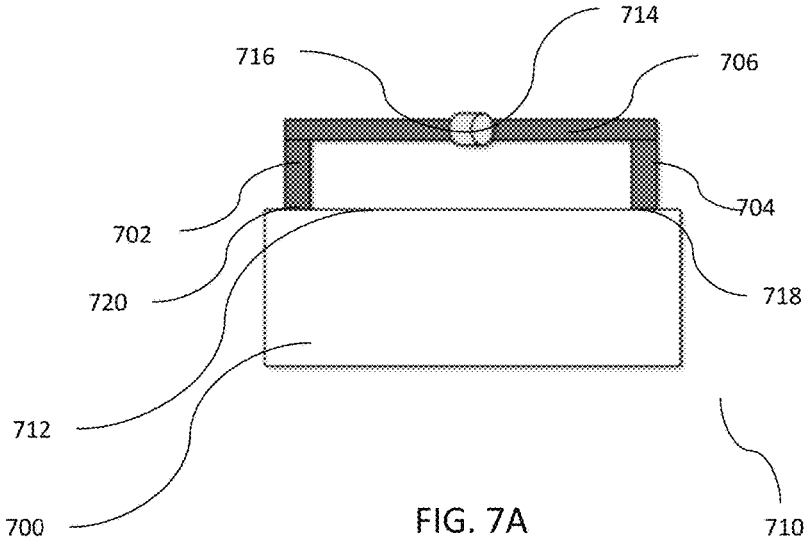
FIG. 7A shows a bag according to an exemplary embodiment of the invention.

FIG. 7A shows a bag according to another exemplary embodiment of the invention in a first configuration. The bag 710 includes an article storage assembly 700, an opening 712, and one handle 706 made of malleable tube as described the for embodiment in FIG. 1.

The handle 706 is made up of a first handle portion 704 and a second handle portion 702. The first handle portion 704 has a first end 718 and a second end 714. The second handle portion 702 and a first end 720 and a second end 716.

The first end 718, 720 of each of the first and second handle portions 702, 704 is detachably secured to the article storage assembly 700, via a suitable connection, as described for the embodiment of FIG. 1. The second end 716, 718 of each of the first handle portion 702 and second handle portion 704 are detachably secured to each other, via suitable connection as described for the embodiment in FIG. 1.

In embodiments, the first end 720 of the second handle portion 702 can be fixedly secured to the article storage assembly 700 via suitable connection as described for the embodiment in FIG. 1.

In embodiments, one end of the first and second handle portions 702, 704 can be fixedly secured to the article storage assembly 700.

In embodiments, part of the handle portion 704 may be rigid.

In embodiments, parts of the first and second handle portions 704, 702 may be rigid.

In embodiments, the first handle portion 702 may be made of malleable tube and the second handle portion 704 may be rigid.

Figure 7B:
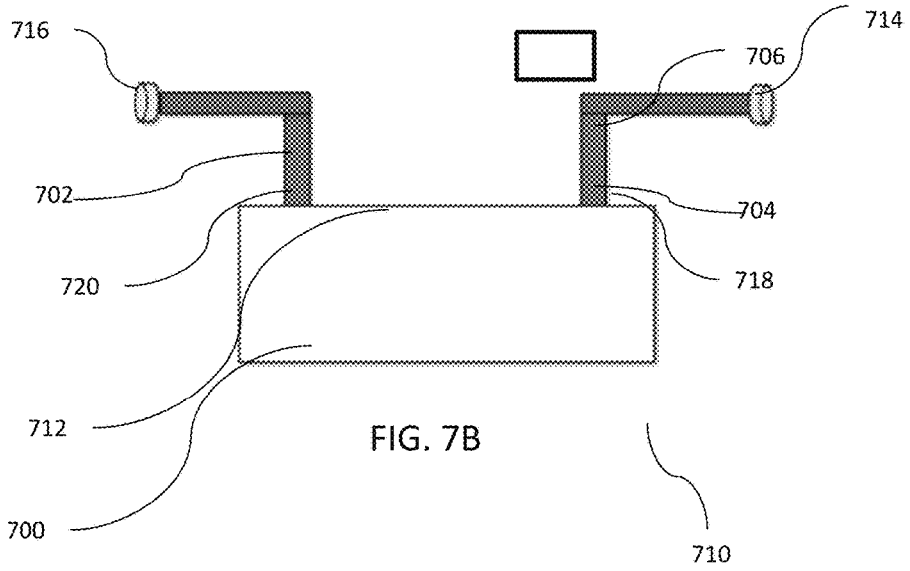
FIG. 7B shows the bag of FIG. 7A with handle portions in an open configuration.

FIG. 7B shows the bag from FIG. 7A with the handle portions 702, 704 configured in an open configuration.

The exemplary embodiments shown in FIGS. 7A and 7B enable users to hang the bag via the handle portions 702, 704 or carry the bag via the handle 706.

Figure 8:
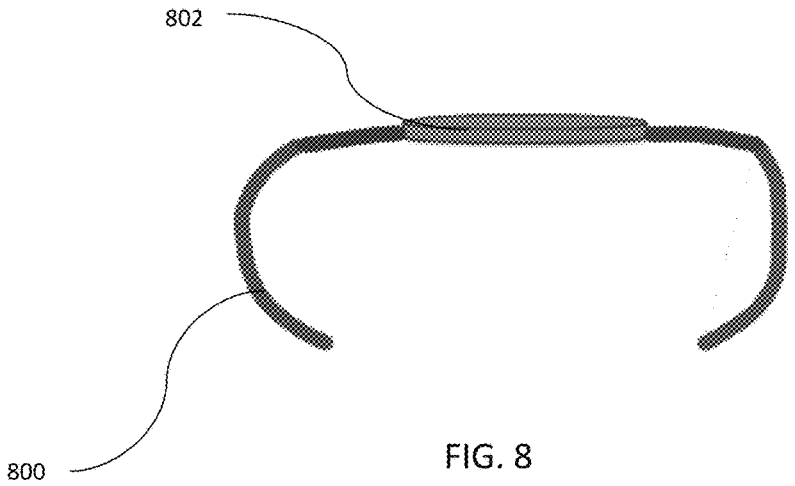
FIG. 8 shows a bag strap according to an exemplary embodiment of the invention.

FIG. 8 shows a bag strap according to another exemplary embodiment of the invention. The bag strap comprises a substantially tubular piece 800, made of malleable tube as described for the embodiment of FIG. 1, with a material cover 802. The cover could be made of many materials as described for the embodiment in FIG. 1.

Figure 9:
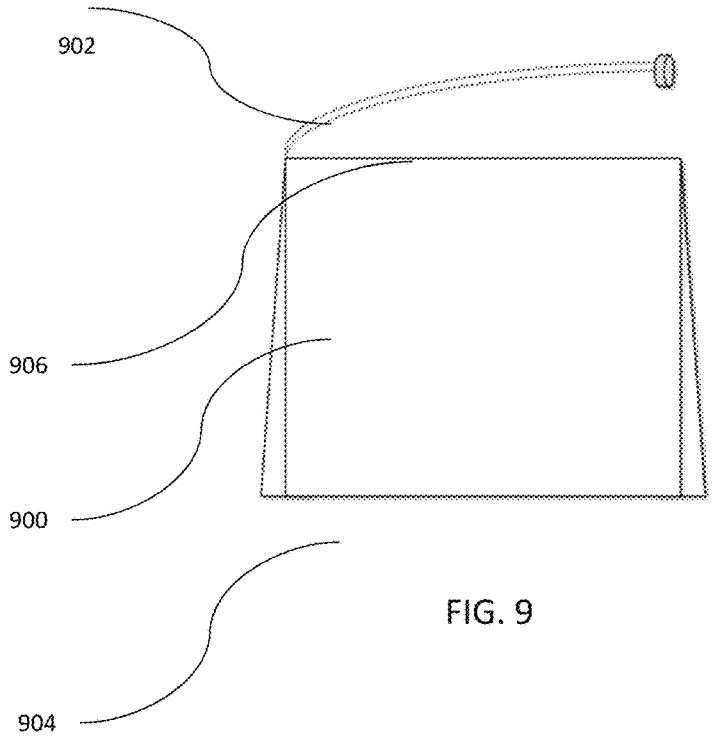
FIG. 9 shows a bag according to another exemplary embodiment of the invention.

FIG. 9 shows a bag according to another exemplary embodiment of the invention. The bag 904 includes an article storage assembly 900, an opening 906, and one handle 902. One end of the first handle portion 902, made of malleable tube s described for the embodiment shown in FIG. 1, is removably secured to the article storage assembly 900, via suitable connection as described for the embodiment shown in FIG. 1.

In other exemplary embodiments, the handle 902 is fixedly secured to the article storage assembly 900 via suitable connection as described for the embodiment shown in FIG. 1.

The embodiment shown in FIG. 9 enables users to carry the bag with the handle directly over the article storage assembly or to rotate the handle and hang it on a table, chair, or the users knee, knees, thigh (with the bag in the user's lap), or leg (with the bag hanging off the side of the user's leg) to prevent theft.

Figure 10A:
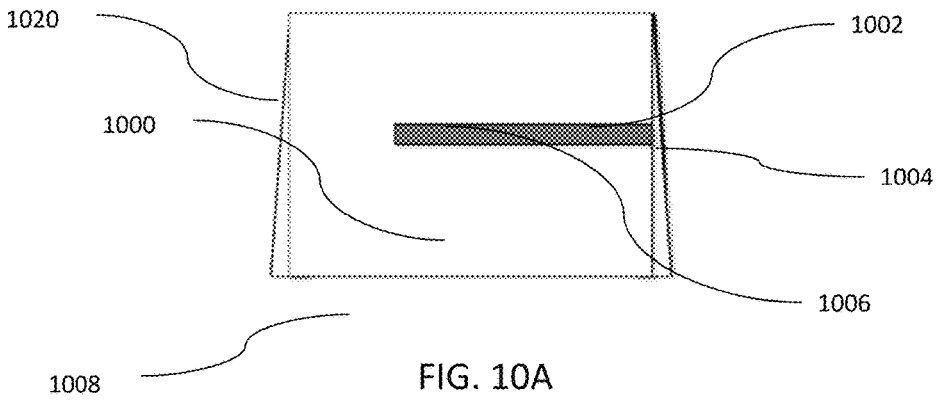
FIG. 10A shows a bag according to an exemplary embodiment of the invention.

FIG. 10A shows a bag according to another exemplary embodiment of the invention. The bag 1008 includes an article storage assembly 1000, an opening 1020, and at least one handle 1002, made of malleable tubing as described for the embodiment of FIG. 1. The handle is made of one handle portion 1006 and an attachment portion 1004.

The attachment portion 1004 is fixed to the bag in one location. The first handle portion 1006 is not fixed to the bag.

Figure 10B:
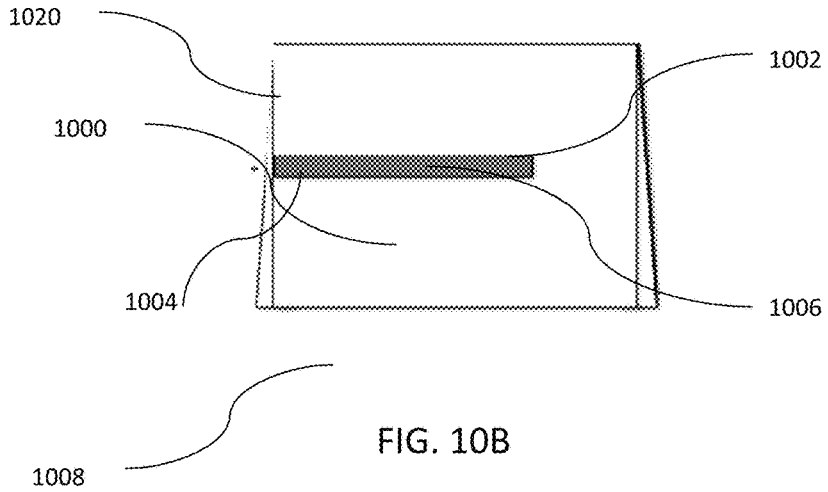
FIG. 10B shows the bag of FIG. 10A from a rear view.

FIG. 10B shows the bag from FIG. 10A from rear perspective.

In embodiments, there is a second handle portion 1002.

Figure 10C:
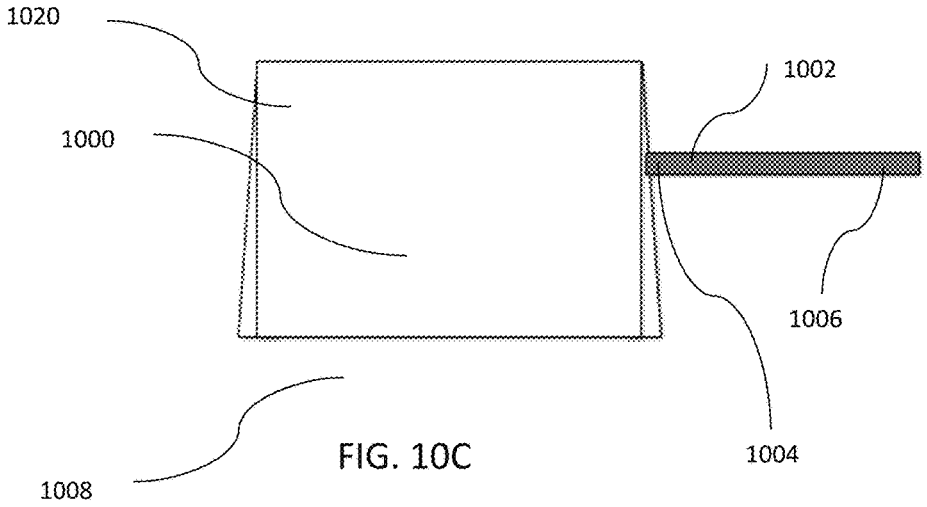
FIG. 10C shows the bag of FIG. 10A in a different configuration.

FIG. 10C show the embodiment shown in FIGS. 10A and B configured with an open handle.

In embodiments, the attachment portion 1004 is not fixed to the article storage assembly 1000. Instead the handle portion 1004 is on a track, and is able to move laterally.

In embodiments of the bag in FIG. 10A, the handle 1002 is removably attached to the bag at the attachment portion 1004.

Figure 10D:
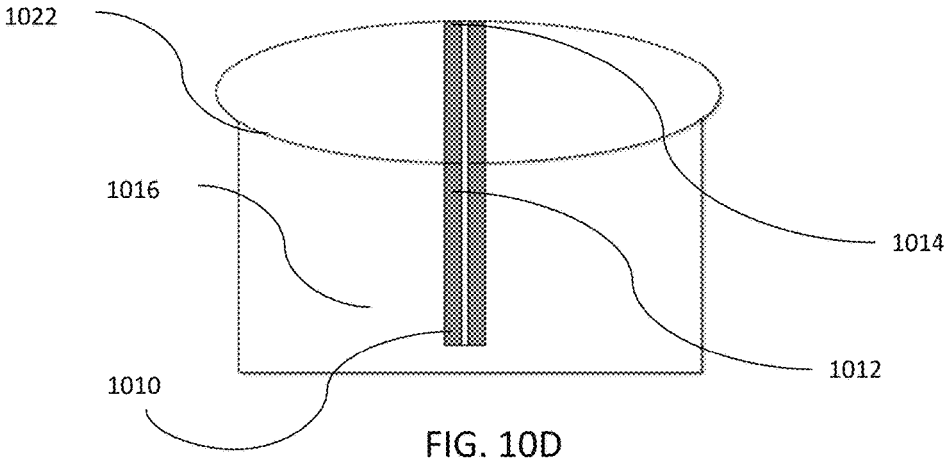
FIG. 10D shows a bag according to an exemplary embodiment of the invention.

FIG. 10D shows an alternate embodiment of the bag in FIG. 10A in which the attachment portion 1014 is fixed to the top edge of the article storage assembly 1016. Furthermore, the handle in the embodiment in FIG. 10E is configured to hold the article storage assembly 1016 closed via applying additional pressure to the bag opening 1022.

The embodiment shown in FIGS. 10A-C enables users to carry the bag with the malleable handle 1008 comfortably curved to their shoulders. Furthermore, users can wrap the handle 1002 around their knee, knees, thigh (with the bag in the user's lap), or leg (with the bag hanging off the side of the user's leg) while sitting to prevent theft.

Figure 11A:
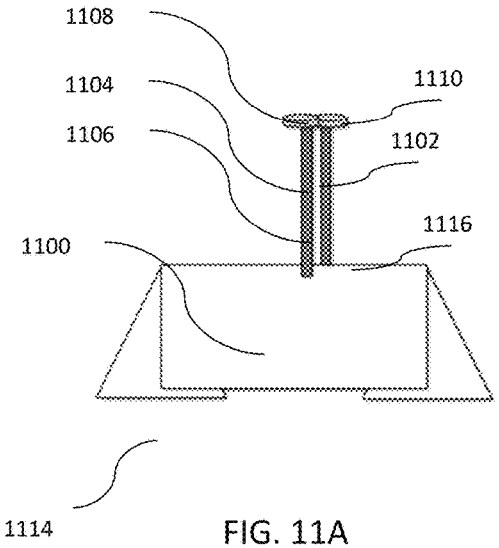
FIG. 11A shows a bag according to an exemplary embodiment of the invention.

FIG. 11A shows a bag according to another exemplary embodiment of the invention. The bag 1114 includes an article storage assembly 1100, an opening 1116, and one handle 1106.

The handle 1106 is made up of a first handle portion 1104 and second handle portion 1102. The handle 1106 is made of malleable tube as described above for the embodiment shown in FIG. 1.

One end of the first handle portion 1104 is secured to the article storage assembly 1100, within the article storage assembly 1100. One end of the second handle portion 1102 is secured to the article storage assembly 1100, within the article storage assembly 1100. The opposite ends of the first and second handle portions 1108, 1110 are removably attached to one another by suitable connection as described above for the embodiment from FIG. 1.

Figure 11B:
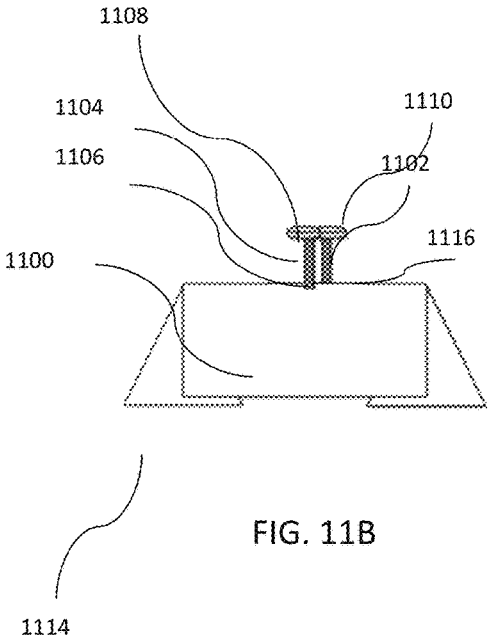
FIG. 11B shows the bag of FIG. 11A with handle portions arranged differently.

In embodiments, the bag first and second handle portions 1104, 1112 includes a length adjusting apparatus that adjusts the length of a corresponding one of the first and second handle portions, FIG. 11B shows the embodiment from FIG. 11A with the handles retracted.

In embodiments, the length adjusting apparatus includes a handle portion base having a first end attached to the article storage assembly 1100 and a second end interconnected with the first end of a corresponding one of the first and second handle portions. A protrusion extends from one of the handle portion base and a corresponding one of the first and second handle portions 1104, 1102. A groove extends longitudinally along the other of the handle portion base and a corresponding one of the first and second handle portions, and the protrusion extends through the groove.

Figure 11C:
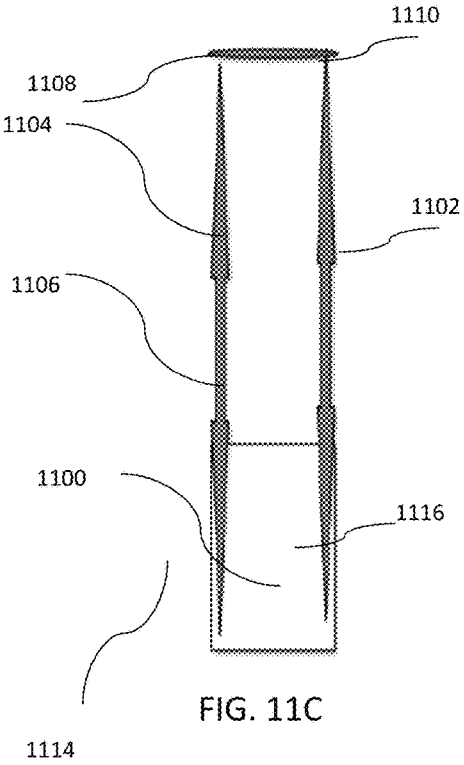
FIG. 11C shows the bag of FIG. 11A from a front view.
Figure 11D:
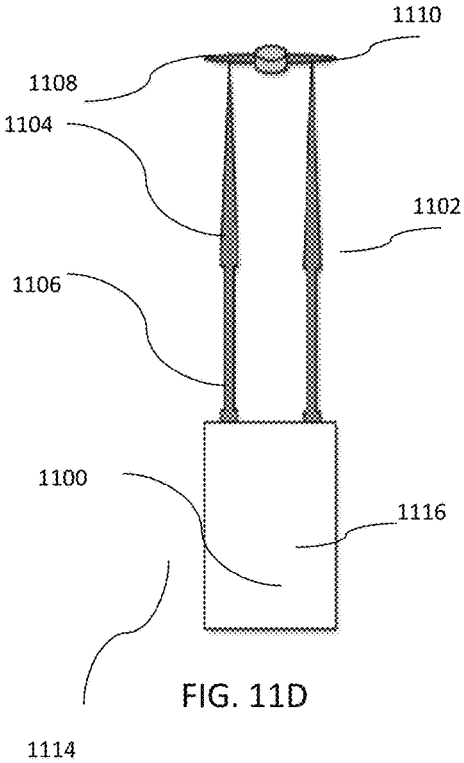
FIG. 11D shows the bag of FIG. 11A from a front view.

FIG. 11C shows a front cut-through view of the embodiment shown in FIG. 11A.

FIG. 11C shows a front view of the embodiment shown in FIG. 11A.

The embodiment shown in FIG. 11A enables users to carry the bag with the malleable handle 1104 comfortably curved to their shoulders. Furthermore, users can wrap the handle 1104 around their legs while sitting, to prevent theft or detach the handle pieces 1104, 1102 to do so with additional configurations. The retractable handles enable the bag to be stored easily.

Figure 12A:
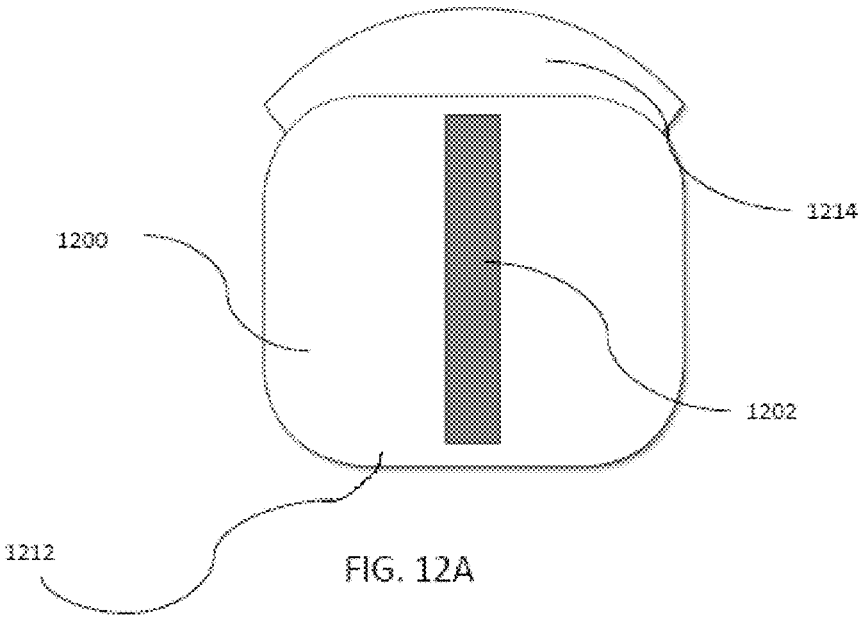
FIG. 12A shows a bag according to an exemplary embodiment of the invention.
Figure 12B:
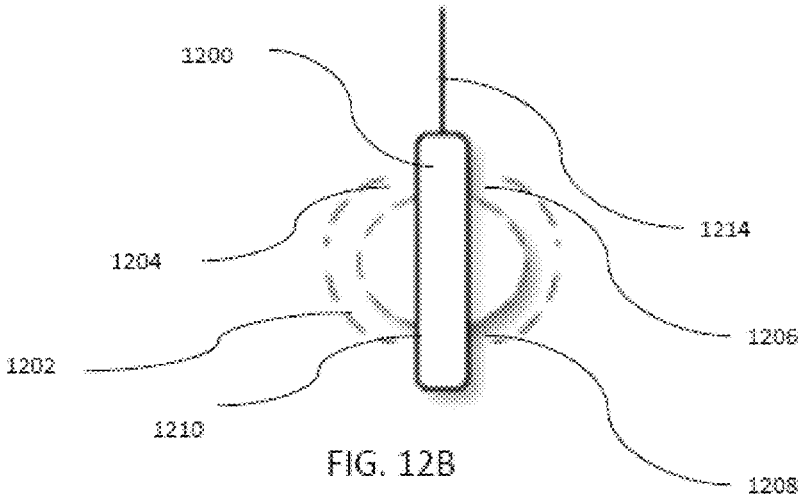
FIG. 12B shows the bag of 12A from a side perspective.

FIGS. 12A and 12B show a front and side view respectively of a bag according to an exemplary embodiment of the invention.

The bag 1212 includes an article storage assembly 1200, an opening 1214, and at least one handle 1202, comprising a full loop and least 2 attachment ports 1204, 1206. The handle 1202 may be made of malleable tube as described for the embodiment of FIG. 1 above.

The handle 1202, passes through the bag via the attachment ports, 1204, 1206, 1208, 1210.

This embodiment allows the handle 1202 to be pulled through the attachment ports 1204, 1206, 1208, 1210 either to tighten the bag, for aesthetic purposes, to allow for hanging, or for other reasons.

Figure 12C:
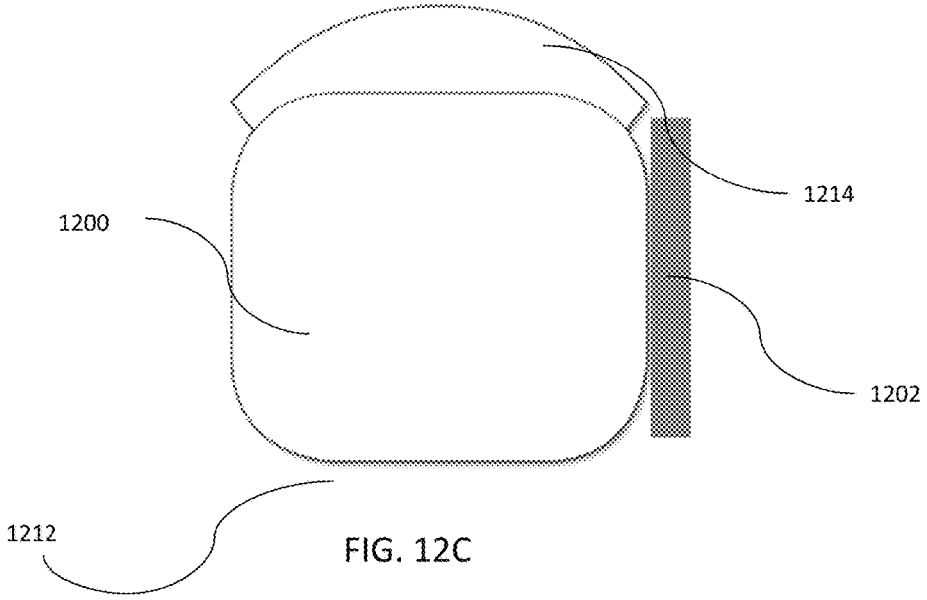
FIG. 12C shows a bag according to an exemplary embodiment of the invention.

FIG. 12C shows an embodiment of the bag of FIGS. 12A and B in which the handle 1202 and attachment ports 1204, 1206 are outside the bag.

The embodiment shown in FIGS. 12A-C enables users to carry the bag with a malleable tube in a number of configurations, as well as hang the bag for added safety.

Figure 13:
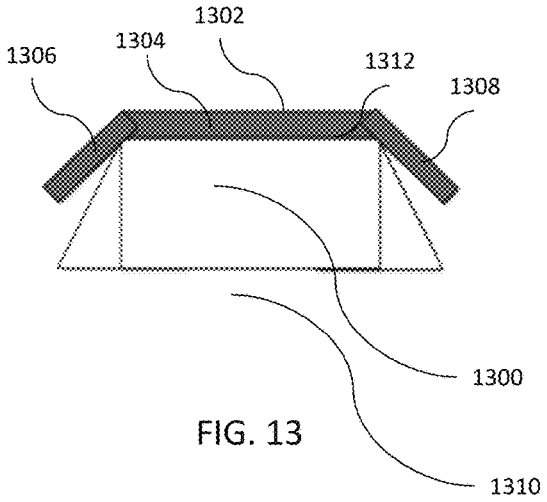
FIG. 13 shows a bag according to an exemplary embodiment of the invention.

FIG. 13 shows a bag according to another exemplary embodiment of the invention. The bag includes an article storage assembly 1300, an opening 1312, and at least one handle 1302 made of malleable tube as described above for the embodiment of FIG. 1. The handle comprises at least three handle portions 1304, 1306, 1308.

The first handle portion 1304, is secured to the article storage assembly 1300 via a suitable connection to allow the handle 1302 to be pulled laterally in the direction of either the second or third handle portions 1306, 1308 such as a loop within the article storage assembly. The second and third handle portions 1306, 1308 may be unsecured.

In embodiments, the first handle portion 1302 is fixedly secured to the article storage assembly 1300.

The embodiment shown in FIG. 13 enables users to wrap the second and third handle portions 1306, 1308 around their legs while sitting, to prevent theft.

Figure 14A:
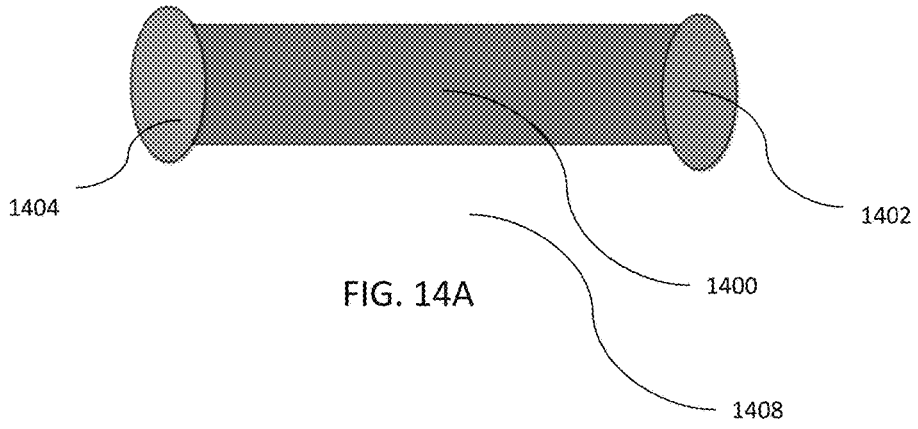
FIG. 14A shows a bag strap according to an exemplary embodiment of the invention.
Figure 14B:
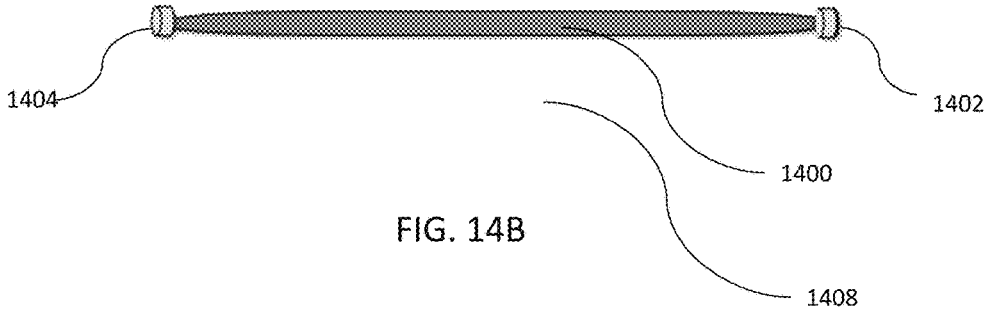
FIG. 14B shows the bag strap of FIG. 14A.
Figure 14C:
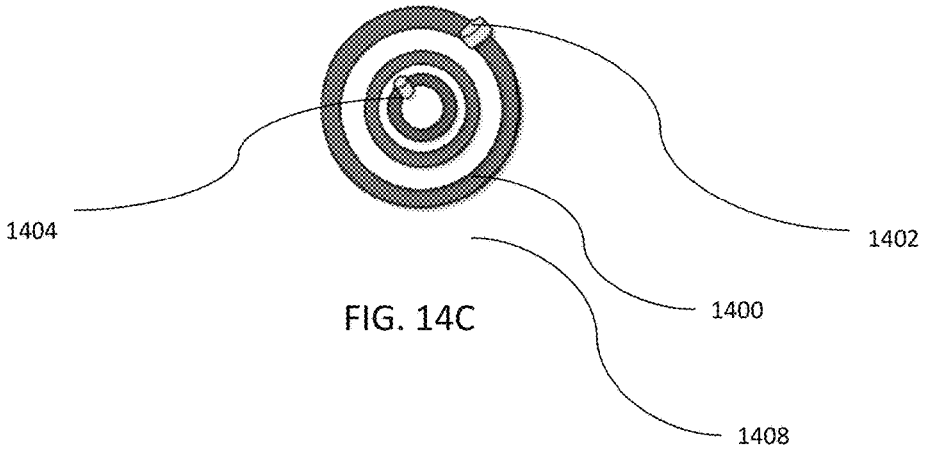
FIG. 14C shows the bag strap of FIG. 14A reshaped for storage.

FIGS. 14A, 14B, and 14C show a bag strap according to another exemplary embodiment of the invention. The bag strap 1408 comprises a substantially tubular piece 1400, made of malleable tube as described for the embodiment shown in FIG. 1, with two ends 1402, 1404.

The opposite ends 1402, 1404 of linear piece 1400 1402, 1404 may be removably attached to one another by suitable connection as described above for the embodiment of FIG. 1.

FIGS. 14B and 14C show the same exemplary embodiment in which the substantially tubular piece 1400 is malleable into a variety of shapes.

The inventors have found that the embodiment shown in FIGS. 14A-C can loop through many existing bags and function as a handle, even if the bag was not designed for it. Users can also wear the substantially tubular piece 1400 as a piece of jewelry, including as a necklace or a bracelet.

Figure 15:
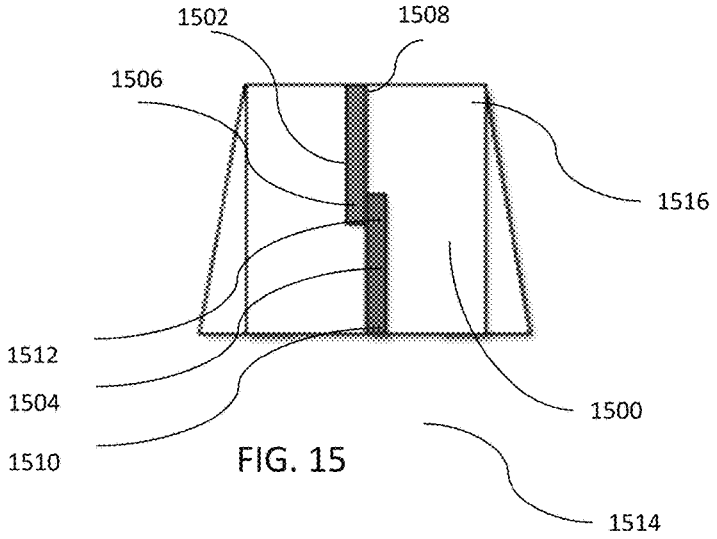
FIG. 15 shows a bag according to an exemplary embodiment of the invention.

FIG. 15 shows a bag according to another exemplary embodiment of the invention. The bag 1514 includes an article storage assembly 1500, an opening 1516 and at least a first and second handle 1502 and 1504. The first handle 1502 has a first and second end 1508, 1506. The second handle 1504 has a first and second end 1510, 1512.

The first and second handles 1502, 1504 are made of malleable tube as described for the embodiment shown in FIG. 1.

The first end 1508 of the first handle 1502 is fixed at one end of the article storage assembly 1500. The first end 1510 of the second handle 1506 is fixed to an opposite end of the article storage assembly 1500.

The embodiment shown in FIG. 15 enables users to wrap the first and second handles 1502, 1504 around their knee, knees, thigh (with the bag in the user's lap), or leg (with the bag hanging off the side of the user's leg) while sitting to prevent theft.

Figure 16:
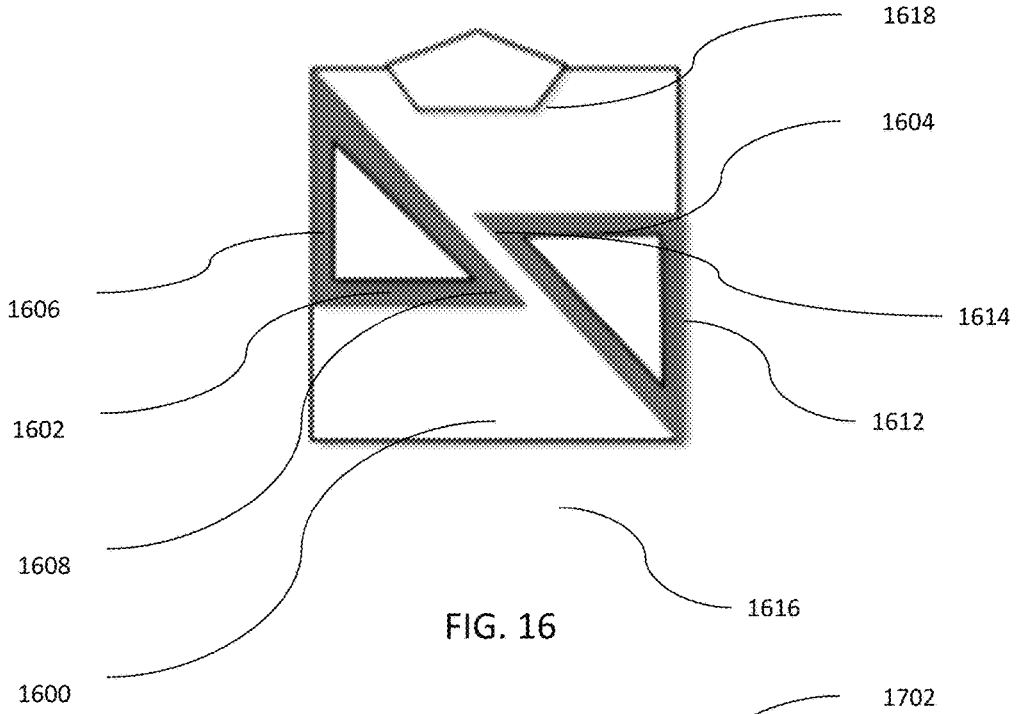
FIG. 16 shows a bag according to an exemplary embodiment of the invention.

FIG. 16 shows a bag according to another exemplary embodiment of the invention. The bag 1616 includes an article storage assembly 1600, an opening 1618, and at least a first and second handle 1602 and 1604. The first handle 1602 is shaped substantially as a triangle with edge 1606 and point 1608. The second handle 1604 is shaped substantially as a triangle with edge 1612 and point 1614.

The first and second handles 1602, 1610 are made of malleable tube as described for the embodiment shown of FIG. 1.

The edge 1606 of the first handle 1602 is fixed to one end of the article storage assembly 1600 via substantial connection as described for the embodiment of FIG. 1. The edge 1612 of the second handle 1610 is fixed to an opposite end of the article storage assembly 1600 via substantial connection as described for the embodiment of FIG. 1.

The embodiment shown in FIG. 16 enables the user to wrap the handles around their knee, knees, thigh (with the bag in the user's lap), or leg (with the bag hanging off the side of the user's leg) while sitting for safety or to hang a bag on a nearby surface.

Figure 17:
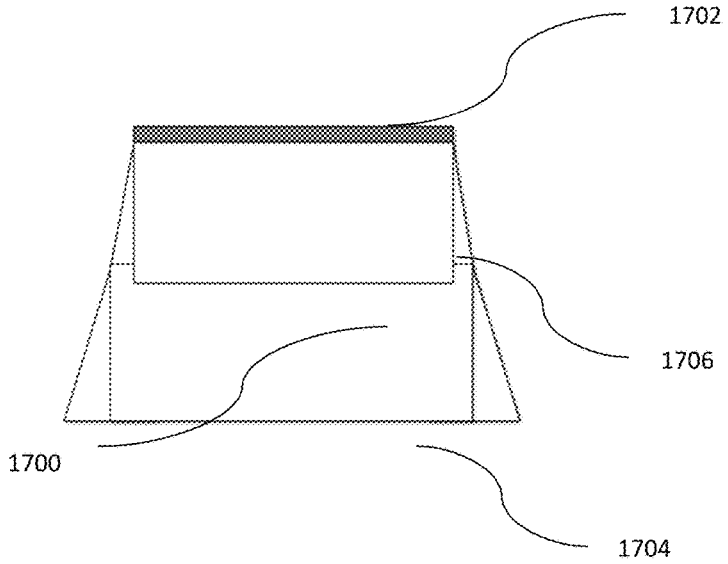
FIG. 17 shows a bag according to an exemplary embodiment of the invention.
Figure 17A:
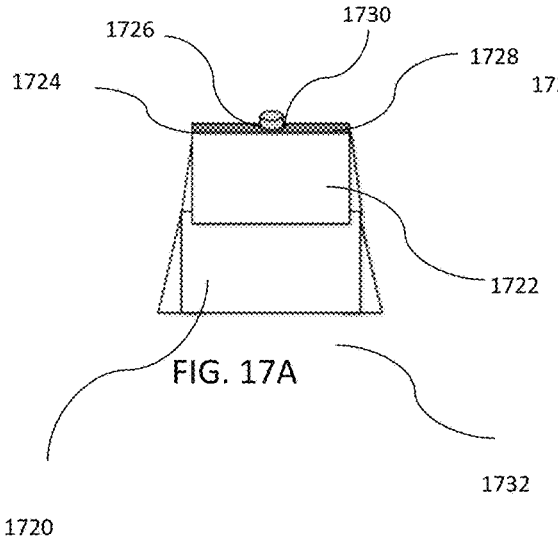
FIG. 17A shows a bag according to an exemplary embodiment of the invention.

FIG. 17 shows a bag according to another exemplary embodiment of the invention. The bag 1704 includes an article storage assembly 1700, an opening 1706, and at least one handle 1702 made of malleable tube as described for the embodiment shown in FIG. 1.

The first handle 1702 is secured to the article storage assembly 1700 via a suitable connection to allow the handle 1702 to be pulled laterally in either direction as described above for the embodiment in FIG. 13.

Figure 17B:
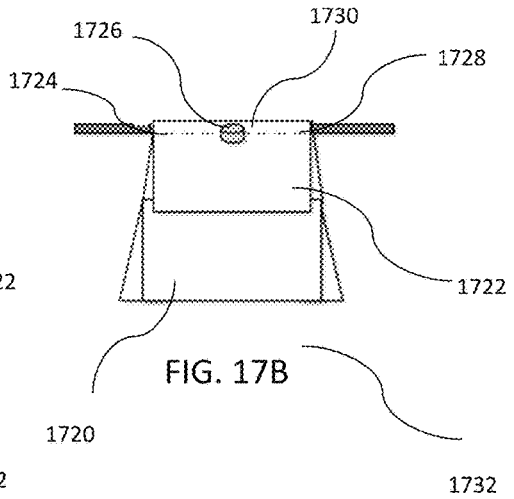
FIG. 17B shows the bag of FIG. 17A in an alternate configuration.

FIG. 17B shows a bag according to another exemplary embodiment of the invention. The bag 1732 includes an article storage assembly 1720, an opening 1722, and at least one handle 1724 made of malleable tube as described for the embodiment shown in FIG. 1. The handle 1724 comprises at least two handle portions 1726, 1728, connected to each other via suitable connection 1730, as described in the embodiment shown in FIG. 1.

The handle portions 1726, 1728 are secured to the article storage assembly 1720 via a suitable connection to allow the portions, 1726, 1728 to be pulled laterally in either direction as described above for the embodiment in FIG. 13.

FIG. 17C shows the embodiment shown in FIG. 17B in an open configuration.

FIGS. 18A-D show a bag according to another exemplary embodiment of the invention. The bag 1800 comprises an article storage assembly 1806, an opening 1808, and a handle 1802 made of malleable tubing as described for the embodiment in FIG. 1. The handle 1802 comprises a cross-bar 1804, and at least one round attachment 1810.

The round attachment 1810 is removably attached to the article storage assembly via a suitable connection as described above for the embodiment in FIG. 1.

Figure 18A:
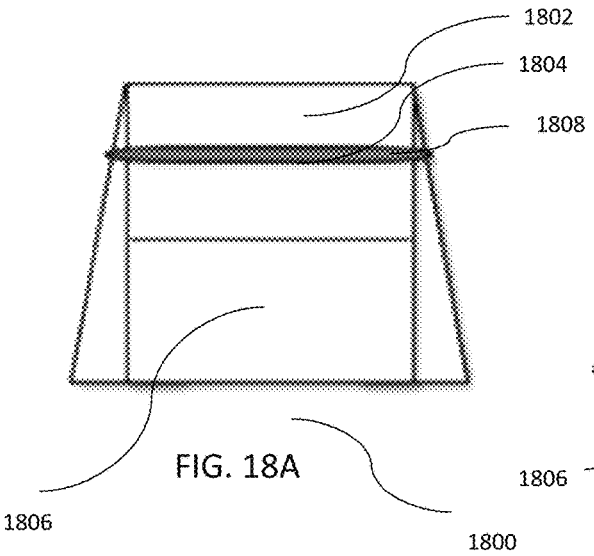
FIG. 18A shows a bag according to an exemplary embodiment of the invention.
Figure 18B:
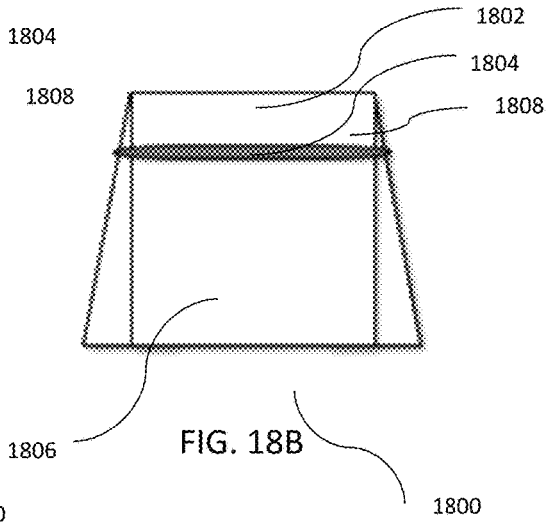
FIG. 18B shows the bag of FIG. 18A from a rear perspective.

FIG. 18B shows a rear view of the embodiment of FIG. 18A

Figure 18C:
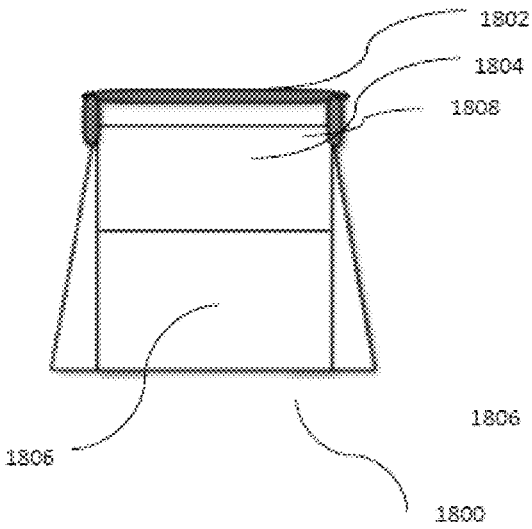
FIG. 18C shows the bag of FIG. 18A in an alternate configuration.

FIG. 18C shows a front view of the embodiment in FIG. 18A configured such that the handle 1802, is bent off the article storage assembly 1806.

Figure 18D:
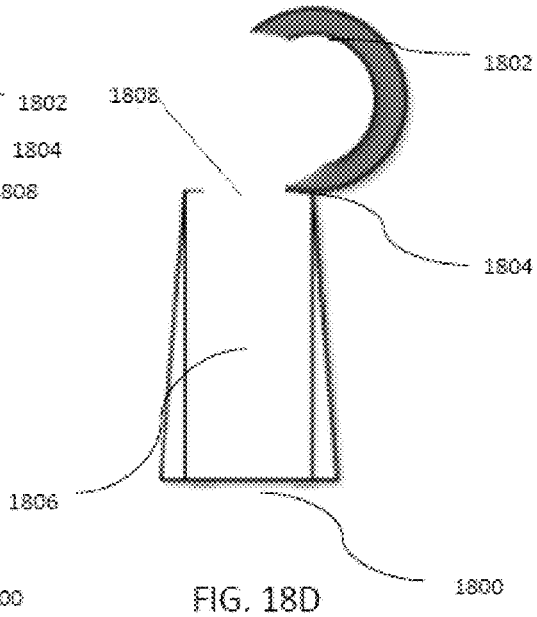
FIG. 18D shows the bag of FIG. 18A in an alternate configuration.

FIG. 18D shows a side view of the embodiment of FIG. 18A configured such that the handle 1802 is bent off the article storage assembly 1806.

Figure 19A:
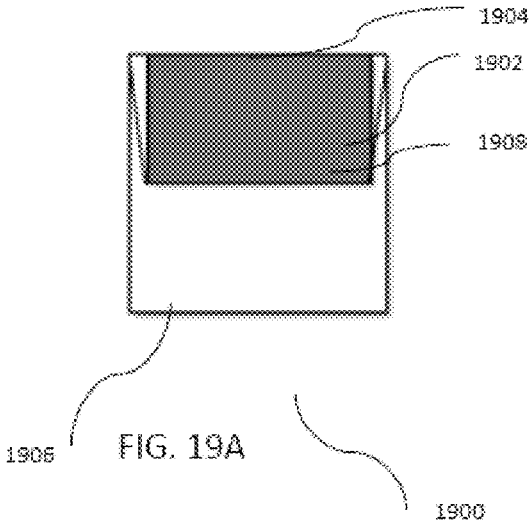
FIG. 19A shows a bag according to an exemplary embodiment of the invention.

FIGS. 19A and B show a bag according to another exemplary embodiment of the invention. The bag 1900 includes an article storage assembly 1906, an opening 1908, and a lid 1902. The lid 1902, has at least one linear edges 1904. The lid 1902 is made of a malleable planar material. Malleable planar material may be formed from one or more materials, such as a metal (such as copper, aluminum, stainless steel, steel, tin, brass, solder alloys, tin-silver-copper alloys, tin-copper-selenium alloys, lead free solder alloys, or zinc, to name a few) or combination of metals (such as a combination of spring steel, copper, stainless steel and beryllium) or from a plastic composite, that have sufficient flexibility, such that a user may adjust of the shape of the planar material to a particular shape, but that are sufficiently stiff or rigid such that the shape is maintained unless the user exerts a force to reshape the plane. As another example, malleable planar material may be formed from a material having elastic properties such as a thermoplastic elastomer (TPE) and more specifically an extruded TPE, which include copolymers or a physical mix of polymers (usually a plastic and a rubber) which consists of materials with both thermoplastic and elastomeric properties. Reinforcement fibers can also be used to add strength to the planar material. Malleable planar material may also be formed from one or more other materials, such as, for example, vinyl or PVC tubing.

One linear edge 1904 of planar lid 1902 is fixedly attached to the article storage assembly 1800.

FIG. 19A shows a front view of the bag 1900 configured such that the lid 1902 is flat and shut.

Figure 19B:
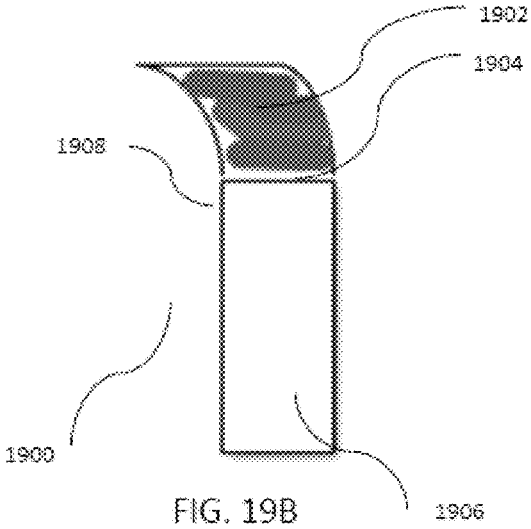
FIG. 19B shows the bag of FIG. 19A in an alternate configuration.

FIG. 19B shows a front view of the bag 1900 configured such that the lid 1902 is flat and open.

The embodiment shown in FIGS. 19A and B allows users to manipulate the lid of the bag to hang the bag on their knee, knees, thigh (with the bag in the user's lap), or leg (with the bag hanging off the side of the user's leg) to provide added safety.

Figure 20A:
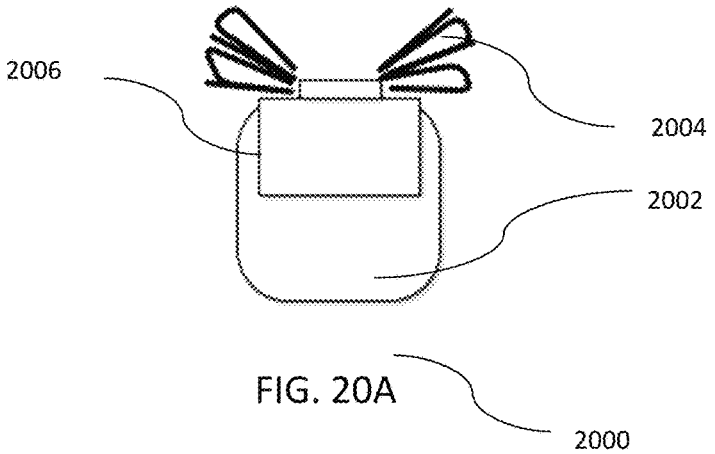
FIG. 20A shows a bag according to an exemplary embodiment of the invention.
Figure 20B:
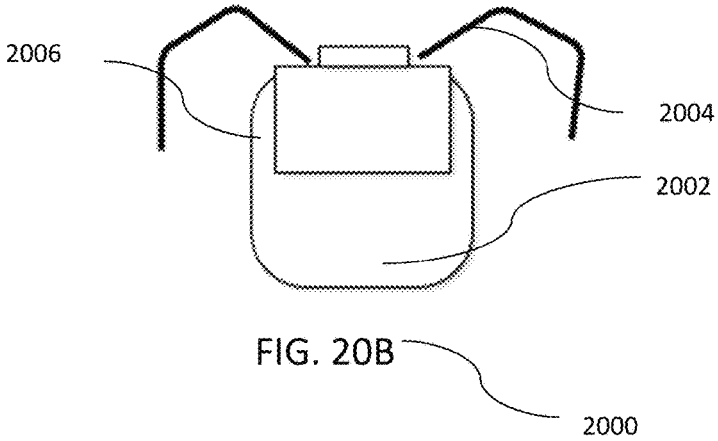
FIG. 20B shows the bag of FIG. 20A in a second configuration.
Figure 20C:
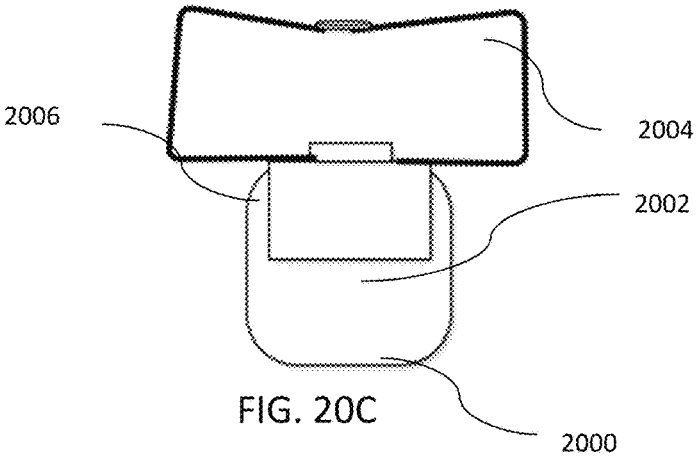
FIG. 20C shows the bag of FIG. 20A in a third configuration.

FIGS. 20A-C show a bag according to another exemplary embodiment of the invention. The bag, 2000 consists of an article storage assembly 2002, an opening 2006, and a handle 2004, made of malleable tube as described for the embodiment in FIG. 1 above. The handle is shaped and creased to move from a closed loop, into a bow shape.

FIG. 20A shows a front view of the bag 2000 when the handle 2004 is configured into a bow.

FIG. 20B shows a front view of the bag 2000 when the handle 2004 is configured between a loop and a bow.

FIG. 20C shows a front view of the bag 2000 when the handle 2004 is configured into a loop.

Figure 21:
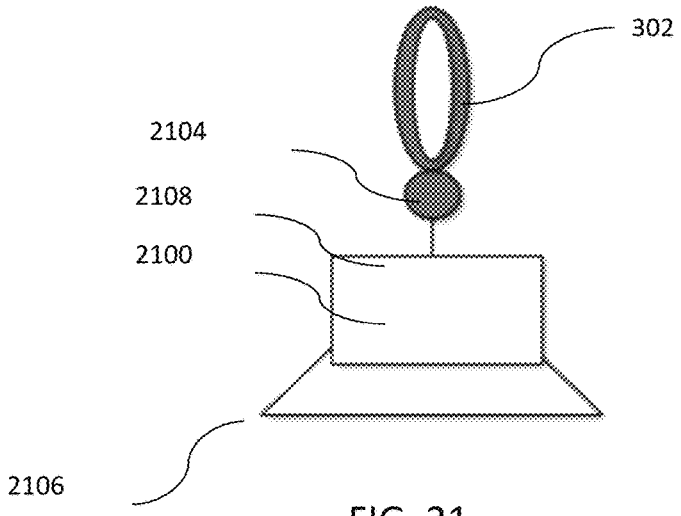
FIG. 21 shows a bag according to an exemplary embodiment of the invention.

FIG. 21 shows a bag according to another exemplary embodiment of the invention. The bag 2106 includes an article storage assembly 2100, an opening 2108, at least one handle 2102, made of malleable tubing, and at least one rotating piece 2104.

The first rotating piece 2104 is connected to the bag via suitable connection. The first handle 2102 is attached to the rotating piece 2104 via suitable connection.

In embodiments, the rotating piece 2104 may have a 180 degree plane of rotation.

In embodiments, the rotating piece 2104 may be a sphere.

In embodiments, the rotating piece 2104 may be a cylinder.

In embodiments, the rotating piece 2104 may lock at a number of locations, possibly including, but not limited to, a position directly perpendicular to the article storage assembly 2100 or a position directly parallel to the article storage assembly 2100.

The embodiment shown in FIG. 21 enables users to carry the bag with the malleable handle 2102 by hand in a plurality of positions. Furthermore, users can wrap the handle 2102 around their knee, knees, thigh (with the bag in the user's lap), or leg (with the bag hanging off the side of the user's leg), while sitting, to prevent theft.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

What is claimed is:

1. A container comprising:

an article storage assembly comprising:

a cavity for storage of one or more items;

an opening comprising:

a first side of the opening with at least a portion of the first side comprising a first threading tube; and a second side of the opening with at least a portion of the second side comprising a second threading tube, wherein the opening has a variable opening distance with a maximum opening distance between a center of the first side and a center of second side;

a first handle in a shape of a closable loop, which is bendable and retains its shape after bending, and which is threaded through the first threading tube with a first threaded length of the first handle enclosed by the threading tube, and a first exposed length of the first handle not enclosed by the threading tube, wherein the first handle comprises:

a first malleable portion comprising:

a first internal core made of substantially rigid material that is bendable into various configurations and retains its shape after bending; and a first outer layer made of material with sufficient flexibility to allow a wearer to adjust of the shape of the first handle;

a first unmalleable portion comprising a layer made of an unmalleable material that covers a portion of the first malleable portion of the handle in a portion of the first exposed length of the first handle, the first unmalleable portion configured to curve around the axis of the first threading tube such that a center of the first unmalleable portion faces to a first lateral direction;

a second handle in a shape of a closable loop, which is bendable and retains its shape after bending, and which is threaded through the second threading tube with a second threaded length of the second handle enclosed by the threading tube, and a second exposed length of the second handle not enclosed by the threading tube, wherein the second handle comprises:

a second malleable portion comprising:

a second internal core made of substantially rigid material that is bendable into various configurations and retains its shape after bending; and a second outer layer made of material with sufficient flexibility to allow a wearer to adjust of the shape of the second handle;

a second unmalleable portion comprising a layer made of an unmalleable material that covers a portion of the second malleable portion of the handle in a portion of the second exposed length of the second handle, the second unmalleable portion configured to curve around the axis of the second threading tube such that a center of the second unmalleable portion faces to a second lateral direction;

the container being configured such that the first handle and the second handle can be moved into a first position and a second position in relation with each other by twisting or turning the first handle, wherein the first position is configured such that the first lateral direction of first unmalleable portion of the first handle faces the same direction as the second lateral direction of the second unmalleable portion of the second handle and nest together, and wherein the second position is configured such that the first lateral direction of first unmalleable portion of the first handle faces the opposite direction as the second lateral direction of the second unmalleable portion of the second handle, and wherein the first handle and the second handle maintain the first position or the second position when the first handle and the second handle are configured in the first position or in the second position and the container is suspended from an object by the first handle and the second handle, such that the container is supported on the object by the first handle and the second handle.

2. The container of claim 1, wherein at least one of the handles has a surface layer surrounding the outer layer.

3. The container of claim 1, wherein the container can be configured into a third position such that the first lateral direction of first unmalleable portion of the first handle faces the same direction as the second lateral direction of the second unmalleable portion of the second handle without nesting together such that the first and second handle fit comfortably over a person's shoulder.

4. The container of claim 1, wherein the first unmalleable portion covers between 10% to 35% of the first exposed length of the first handle.

5. The container of claim 1, wherein the first threaded length is between 15% to 25% of the sum of the first threaded length and the first exposed length of the first handle.

6. The container of claim 1, wherein the first inner core comprises at least one of the metals selected from a group consisting of copper, aluminum, stainless steel, steel, tin, brass, solder alloys, tin-silver-copper alloys, tin-copper-selenium alloys, lead free solder alloys, and zinc.

7. The container of claim 1, wherein the first inner core comprises at least one of the polymers selected from a group consisting of thermoplastic elastomer and plastic composite.

8. The container of claim 1, wherein the first outer layer comprises at least one of the polymers selected from a group consisting of PVC, plastic, fabric, leather, vinyl, neoprene, woven fur, celluloid, sheepskin.

9. The container of claim 1, wherein the article storage assembly is a lunch box.

10. A container comprising:

an article storage assembly comprising:

a cavity for storage of one or more items;

an opening comprising:

a first side of the opening with at least a portion of the first side comprising a first threading tube; and a second side of the opening with at least a portion of the second side comprising a second threading tube, wherein the opening has a variable opening distance with a maximum opening distance between a center of the first side and a center of second side;

a first handle in a shape of a closable loop, which is bendable and retains its shape after bending, and which is threaded through the first threading tube with a first threaded length of the first handle enclosed by the threading tube, and a first exposed length of the first handle not enclosed by the threading tube, wherein the first handle comprises:

a first malleable portion comprising:

a first internal core made of substantially rigid material that is bendable into various configurations and retains its shape after bending; and a first outer layer made of material with sufficient flexibility to allow a wearer to adjust of the shape of the first handle;

a first unmalleable portion comprising a layer made of an unmalleable material that covers a portion of the first malleable portion of the handle in a portion of the first exposed length of the first handle, the first unmalleable portion configured to curve around the axis of the first threading tube such that a center of the first unmalleable portion faces to a first lateral direction;

a second handle in a shape of a closable loop, which is bendable and retains its shape after bending, and which is threaded through the second threading tube with a second threaded length of the second handle enclosed by the threading tube, and a second exposed length of the second handle not enclosed by the threading tube, wherein the second handle comprises:

a second malleable portion comprising:

a second internal core made of substantially rigid material that is bendable into various configurations and retains its shape after bending; and a second outer layer made of material with sufficient flexibility to allow a wearer to adjust of the shape of the second handle;

a second unmalleable portion comprising a layer made of an unmalleable material that covers a portion of the second malleable portion of the handle in a portion of the second exposed length of the second handle, the second unmalleable portion configured to curve around the axis of the second threading tube such that a center of the second unmalleable portion faces to a second lateral direction;

the container being configured such that the first handle and the second handle can be moved into a first position and a second position in relation with each other by twisting or turning the first handle, wherein the first position is configured such that the first lateral direction of first unmalleable portion of the first handle faces the same direction as the second lateral direction of the second unmalleable portion of the second handle and nest together, and wherein the second position is configured such that the first lateral direction of first unmalleable portion of the first handle faces the same direction as the second lateral direction of the second unmalleable portion of the second handle without nesting together so as to fit comfortably on a person's shoulders, and wherein the first handle and the second handle maintain the first position or the second position when the first handle and the second handle are configured in the first position or in the second position and the container is suspended from an object by the first handle and the second handle such that the container is supported on the object by the first handle and the second handle.

11. The container of claim 10, wherein at least one of the handles has at least one surface layer surrounding the outer layer.

12. The container of claim 10, wherein the container can be configured into a third position configured such that the first lateral direction of first unmalleable portion of the first handle faces the opposite direction as the second lateral direction of the second unmalleable portion of the second handle.

13. The container of claim 10, wherein the first unmalleable portion covers between 10% to 35% of the first handle.

14. The container of claim 10, wherein the first threaded length is between 15% to 25% of the sum of the first threaded length and the first exposed length of the first handle.

15. A The container of claim 10, wherein the first inner core comprises at least one of the metals selected from a group consisting of copper, aluminum, stainless steel, steel, tin, brass, solder alloys, tin-silver-copper alloys, tin-copper-selenium alloys, lead free solder alloys, and zinc.

16. The container of claim 10, wherein the first inner core comprises at least one of the polymers selected from a group consisting of thermoplastic elastomer and plastic composite.

17. The container of claim 10, wherein the first outer layer comprises at least one of the polymers selected from a group consisting of PVC, plastic, fabric, leather, vinyl, neoprene, woven fur, celluloid, and sheepskin.

18. The container of claim 10, wherein the article storage assembly is a lunch box.

19. The container of claim 10, wherein fitting comfortably on a person's shoulders in the second position comprises the first handle placed atop a first shoulder of the wearer and the second handle placed atop a second shoulder of the wearer, wherein the article storage assembly hangs from the first handle and the second handle as a backpack on the wearer, and wherein no portion of the first handle or of the second handle is situated under an armpit of the wearer when the container is in the second position and fit on the wearer's shoulders.

* * * * *